US007137874B1

(12) United States Patent
Bovio et al.

(10) Patent No.: US 7,137,874 B1
(45) Date of Patent: Nov. 21, 2006

(54) SEMICONDUCTOR WAFER, POLISHING APPARATUS AND METHOD

(75) Inventors: Ezio Bovio, Bellinzago Novarese (IT); Paride Corbellini, Trecate (IT); Marco Morganti, Novara (IT); Giovanni Negri, Sizzano (IT); Peter D. Albrecht, O'Fallon, MO (US)

(73) Assignee: MEMC Electronic Materials, SpA, Novara (IT)

( * ) Notice: Subject to any disclaimer, the term of this patent is extended or adjusted under 35 U.S.C. 154(b) by 0 days.

(21) Appl. No.: 10/432,513

(22) PCT Filed: Nov. 21, 2000

(86) PCT No.: PCT/IT00/00471

§ 371 (c)(1),
(2), (4) Date: Oct. 14, 2003

(87) PCT Pub. No.: WO02/42033

PCT Pub. Date: May 30, 2002

(51) Int. Cl.
*B24B 1/00* (2006.01)

(52) U.S. Cl. ..... 451/41; 451/285; 451/286; 451/287; 451/288; 451/289; 451/385; 451/358; 451/398

(58) Field of Classification Search ..... 451/41, 451/285, 286, 287, 288, 289, 385, 388, 398
See application file for complete search history.

(56) References Cited

U.S. PATENT DOCUMENTS 3,708,921 A * 1/1973 Cronkhite et al. ..... 451/41
5,377,451 A 1/1995 Leoni et al.
5,605,487 A 2/1997 Hileman et al.
5,738,568 A 4/1998 Jurjevic et al.
5,762,544 A * 6/1998 Zuniga et al. ..... 451/285
5,791,978 A 8/1998 Cesna et al.
5,899,798 A 5/1999 Trojan et al.

(Continued)

FOREIGN PATENT DOCUMENTS

EP 0 362 811 A2 4/1990

(Continued)

OTHER PUBLICATIONS

PCT International Search Report for PCT Patent Application PCT/IT00/00471, Nov. 22, 2001, 3 pages, European Patent Office, Rijswijk.

*Primary Examiner*—Lee D. Wilson
*Assistant Examiner*—Shantese McDonald
(74) *Attorney, Agent, or Firm*—Senniger Powers

(57) ABSTRACT

A wafer polishing apparatus for polishing a semiconductor wafer. The polisher comprises a base (23), a turntable (27), a polishing pad (29) and a drive mechanism (45) for driven rotation of a polishing head (63). The polishing head is adapted to hold at least one wafer (35) for engaging a front surface of the wafer with a work surface of the polishing pad. A spherical bearing assembly (75) mounts the polishing head (63) on the drive mechanism for pivoting of the polishing head about a gimbal point (p) lying no higher than the work surface when the polishing head holds the wafer in engagement with the polishing pad. This pivoting allowing the plane of the front surface of the wafer to continuously align itself to equalize polishing pressure over the front surface of the wafer, while rotation of the polishing head is driven by the driving mechanism. This maintains the front surface and work surface in a continuously parallel relationship for more uniform polishing of a semiconductor wafer, particularly near the lateral edge of the wafer. A cassette of wafers and method of polishing are also disclosed.

30 Claims, 20 Drawing Sheets

U.S. PATENT DOCUMENTS 5,916,015 A 6/1999 Natalicio
5,957,751 A 9/1999 Govzman et al.
6,048,259 A * 4/2000 Asai ..... 451/339
6,068,549 A 5/2000 Jackson
6,106,378 A * 8/2000 Perlov et al. ..... 451/288
6,755,723 B1 * 6/2004 Pham ..... 451/41

FOREIGN PATENT DOCUMENTS

EP 0 934 801 A2 8/1999
EP 1 049 145 A1 11/2000

* cited by examiner

SEMICONDUCTOR WAFER, POLISHING APPARATUS AND METHOD

BACKGROUND OF THE INVENTION

This invention relates to apparatus for polishing semiconductor or similar type materials, and more specifically to such apparatus which facilitates equalization of the downward pressure over the polished wafer surface and/or the polishing head of the apparatus.

Polishing an article to produce a surface which is highly reflective and damage free has application in many fields. A particularly good finish is required when polishing an article such as a wafer of semiconductor material in preparation for printing circuits on the wafer by an electron beam-lithographic or photolithographic process (hereinafter "lithography"). Flatness of the wafer surface on which circuits are to be printed is critical in order to maintain resolution of the lines, which can be as thin as 0.13 microns (5.1 microinches) or less. The need for a flat wafer surface, and in particular local flatness in discrete areas on the surface, is heightened when stepper lithographic processing is employed.

Flatness is quantified in terms of a global flatness variation parameter (for example, total thickness variation ("TTV")) or in terms of a local site flatness variation parameter (e.g., Site Total Indicated Reading ("STIR") or Site Focal Plane Deviation ("SFPD")) as measured against a reference plane of the wafer (e.g., Site Best Fit Reference Plane). STIR is the sum of the maximum positive and negative deviations of the surface in a small area of the wafer from a reference plane, referred to as the "focal" plane. SFQR is a specific type of STIR measurement, as measured from the front side best fit reference plane. A more detailed discussion of the characterization of wafer flatness can be found in F. Shimura, Semiconductor Silicon Crystal Technology 191–195 (Academic Press 1989). Presently, flatness parameters of the polish surfaces of single side polished wafers are typically acceptable within a central portion of most wafers, but the flatness parameters become unacceptable near the edges of the wafers, as described below.

The construction of conventional polishing machines contributes to unacceptable flatness measurements near the wafer's edge. Polishing machines typically include an annular polishing pad mounted on a turntable for driven rotation about a vertical axis passing through the center of the pad. The wafers are fixedly mounted on pressure plates above the polishing pad and lowered into polishing engagement with the rotating polishing pad. A polishing slurry, typically including chemical polishing agents and abrasive particles, is applied to the pad for greater polishing interaction between the polishing pad and the wafer.

In order to achieve the degree of polishing needed, a substantial normal force presses the wafers into engagement with the pad. The coefficient of friction between the pad and wafer creates a significant lateral force on the wafer. This lateral force can give rise to certain distortions in the polish, such as by creating a vertical component of the frictional force at the leading edge of a wafer. The vertical component of the frictional force is created because the wafer is mounted to pivot about a gimbal point under influences of the lateral friction forces. A change in the net vertical force applied to the wafer locally changes the polishing pressure and the polishing rate of the wafer, giving rise to distortions in the polish. Often the uneven forces cause the wafer's peripheral edge margin to be slightly thinner than the majority of the wafer, rendering the edge margin of the wafer unusable for lithographic processing. This condition is a sub-species of the more general problems associated with wafer flatness, and will be referred to hereinafter as edge roll-off.

Improvements in wafer polishers have helped reduce edge roll-off. Recent designs have incorporated conic bearing assemblies between the wafer and the mechanism applying the polishing force while permitting free rotation of the wafer. Conic bearing assemblies are an improvement over traditional ball and socket configurations because the gimbal point of the mechanism is at a point below the bearing, nearer the interface between the wafer and the polishing pad. As the polishing pad rotates beneath the polishing head, friction between the pad and the wafer create horizontal forces on the head, creating a moment on the head. This moment cants the polishing head with respect to the pad, applying greater force to the leading edge of the head. By lowering the pivot point of the polishing head toward a work surface of the polishing pad, or slightly below the surface, the torque moment applied to the polishing head by frictional forces is either minimized, eliminated or imparted in a more desirable direction. Control of this moment results in more uniform polishing pressure at all points on the wafer and in more uniform wear of the polishing pad. Wafers polished with a gimbal point near the work surface exhibit superior flatness characteristics, particularly near the outer edge of the wafer where conventional polishing processes exhibit characteristic "roll-off" and near the center of the wafer where slurry starvation may occur. Roll-off occurs in polishers having a gimbal point above the work surface where the torque on the polishing head due to friction presses the leading edge of the polishing head, and the wafer, into the polishing pad. Slurry starvation occurs when the leading edge of the wafer and head press into the polishing pad, pushing the slurry forward and inhibiting the slurry from flowing between the pad and the wafer. Despite these improvements in the prior art, the edge of the wafer may still exhibit unacceptable roll-off and the center of the wafer may be insufficiently polished.

Controlling wafer rotation while lowering the gimbal point to at or below the work surface is more desirable, because controlling the gimbal point of the mechanism and the rotational speed of both the polishing pad and the wafer allows more control over the wafer polishing process. Freely rotating polishing heads, in contrast, provide little control over the polishing process, as the polishing head and wafer simply rotate in response to frictional forces between the wafer and the polishing pad. Frictional forces can change between wafers and from one polishing machine to the next (due to turntable and drive mechanism misalignment, for instance), varying the rotational speed of the polishing head and the characteristics of the wafer polish. This process can lead to uneven polishing between wafers and cause increased degradation of the interior of the polishing pad. Since a freely rotating wafer will tend to rotate at a faster rate, the inside of the polishing pad sees more linear feet of wafer, wearing the pad more quickly near the pad's center. When the pad wears more quickly near the center, wafer flatness degrades because the pad is no longer flat. If the rotational speed of the wafer is decreased, polishing quality is greatly improved due to more uniform wear across the polishing pad. Moreover, pad wear impacts any "dishing" or "doming" of the wafer surface, which can be more effectively controlled by the rotational speed of the wafer. Thus, an improved design is needed incorporating further features, such as a low gimbal point and wafer rotation control, for inhibiting edge roll-off and improving wafer flatness generally.

SUMMARY OF THE INVENTION

Among the several objects and features of the present invention may be noted the provision of a semiconductor wafer, semiconductor wafer polishing apparatus and method which improves the flatness of the wafers processed; the provision of such a wafer, apparatus and method which reduces wafer edge roll-off; the provision of such a wafer, apparatus and method which increases the area of the wafer usable for lithographic processing; and the provision of such a wafer, apparatus and method which improves site to site consistency between the outer ring sites and the inner ring sites on the wafer.

Generally, a wafer polishing apparatus of the present invention comprises a base for supporting elements of the polishing apparatus. A turntable having a polishing pad thereon mounts on the base for rotation of the turntable and polishing pad relative to the base about an axis perpendicular to the turntable and polishing pad. The polishing pad includes a work surface engageable with a front surface of a wafer for polishing the front surface of the wafer. A drive mechanism mounts on the base for imparting rotational motion about an axis substantially parallel to the axis of the turntable. A polishing head connected to the drive mechanism for driven rotation of the polishing head is adapted to hold at least one wafer for engaging a front surface of the wafer with the work surface of the polishing pad. A spherical bearing assembly mounts the polishing head on the drive mechanism for pivoting of the polishing head about a gimbal point lying no higher than the interface of the front surface of the wafer and the work surface when the polishing head holds the wafer in engagement with the polishing pad. This pivoting allows the plane of the front surface of the wafer to continuously align itself to equalize polishing pressure over the front surface of the wafer, while rotation of the polishing head is driven by the driving mechanism. This maintains the front surface and work surface in a continuously parallel relationship for more uniform polishing of a semiconductor wafer.

In another aspect of the present invention, a method of polishing a semiconductor wafer generally comprises placing the semiconductor wafer in a polishing head of a wafer polishing apparatus and driving rotation of a polishing pad on a turntable of the polishing apparatus about a first axis. Rotation of the polishing head is driven generally about a second axis non-coincident with the first axis. The wafer held by the polishing head is positioned so that a front surface of the wafer engages a work surface of the polishing pad and is urged against the polishing pad. The polishing head is held for free pivoting movement about a gimbal point located no higher than the interface of the work surface and the front surface of the wafer, as rotation of the polishing head continues to be driven, so that the plane of the front surface of the wafer can equalize polishing pressure over the front surface of the wafer of the polishing pad in response to a net force about the gimbal point acting in a direction perpendicular to the front surface of the wafer, while preventing pivoting of the front surface of the wafer under forces parallel to the front surface of the wafer passing generally through the gimbal point. The wafer is disengaged from the turntable and the wafer is removed from the polishing head.

In a final aspect of the present invention, a cassette of single side polished, monocrystalline semiconductor wafers is disclosed. The wafers each comprise a central axis and a front surface generally perpendicular to the central axis and polished to a finish polish. The wafers further comprise a back surface which is not polished to a finish polish and a circumferential edge. The front surface is uniformly flat for use in lithographic imprinting of circuits thereon in an area from the central axis at least to within 2 millimeters (0.08 inches) of the circumferential edge. The wafers are not selected according to their flatness.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
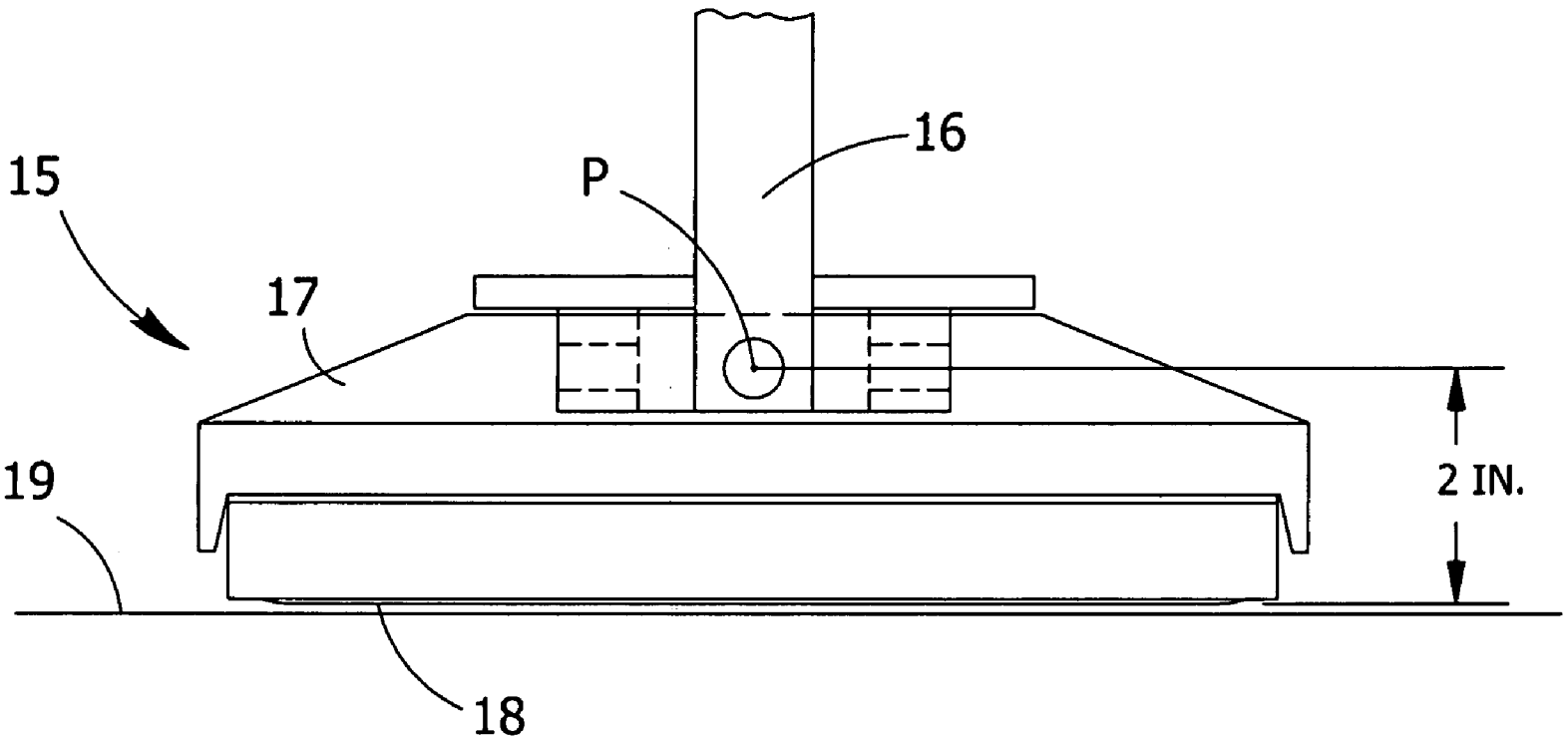
FIG. 1 PRIOR ART
FIG. 1 is a schematic side elevation of a conventional wafer polishing apparatus.

Referring now to the figures, and specifically FIG. 1, a schematic of a conventional wafer polishing apparatus, generally indicated at 15, includes a mounting shaft 16, a polishing head 17, a wafer 18 and a polishing pad 19. The shaft 16, polishing head 17 and wafer 18 rotate about a vertical axis, as the wafer is pressed into the polishing pad 19 to polish the wafer. As will be discussed in greater detail below, the polishing head 17 must pivot with respect to the shaft 16, so that the wafer 18 may remain in flatwise engagement with the polishing pad 19. The polishing head 17 and wafer 18 are mounted to pivot with respect to the shaft 16 about a gimbal point P. In many conventional polishers, including the schematic of FIG. 1, the gimbal point P is located well above the interface of the wafer 18 and the polishing pad 19. The distance from the pad 19 to the gimbal point P is often as large a several inches, such as the two inch distance depicted in FIG. 1.

Figure 1A:
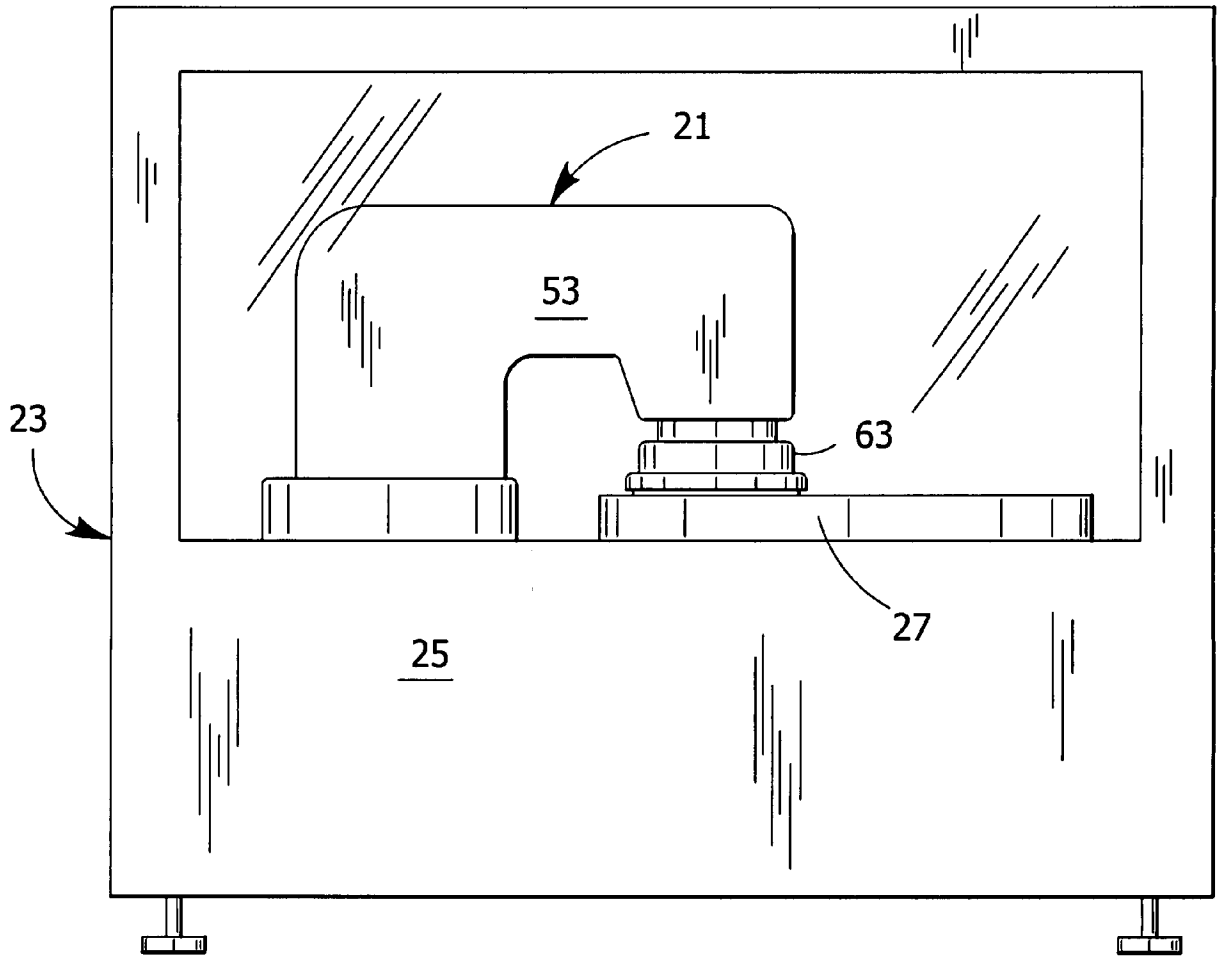
FIG. 1A is a schematic side elevation of the wafer polishing apparatus of FIG. 1 inside a non-contamination booth.
Figure 1B:
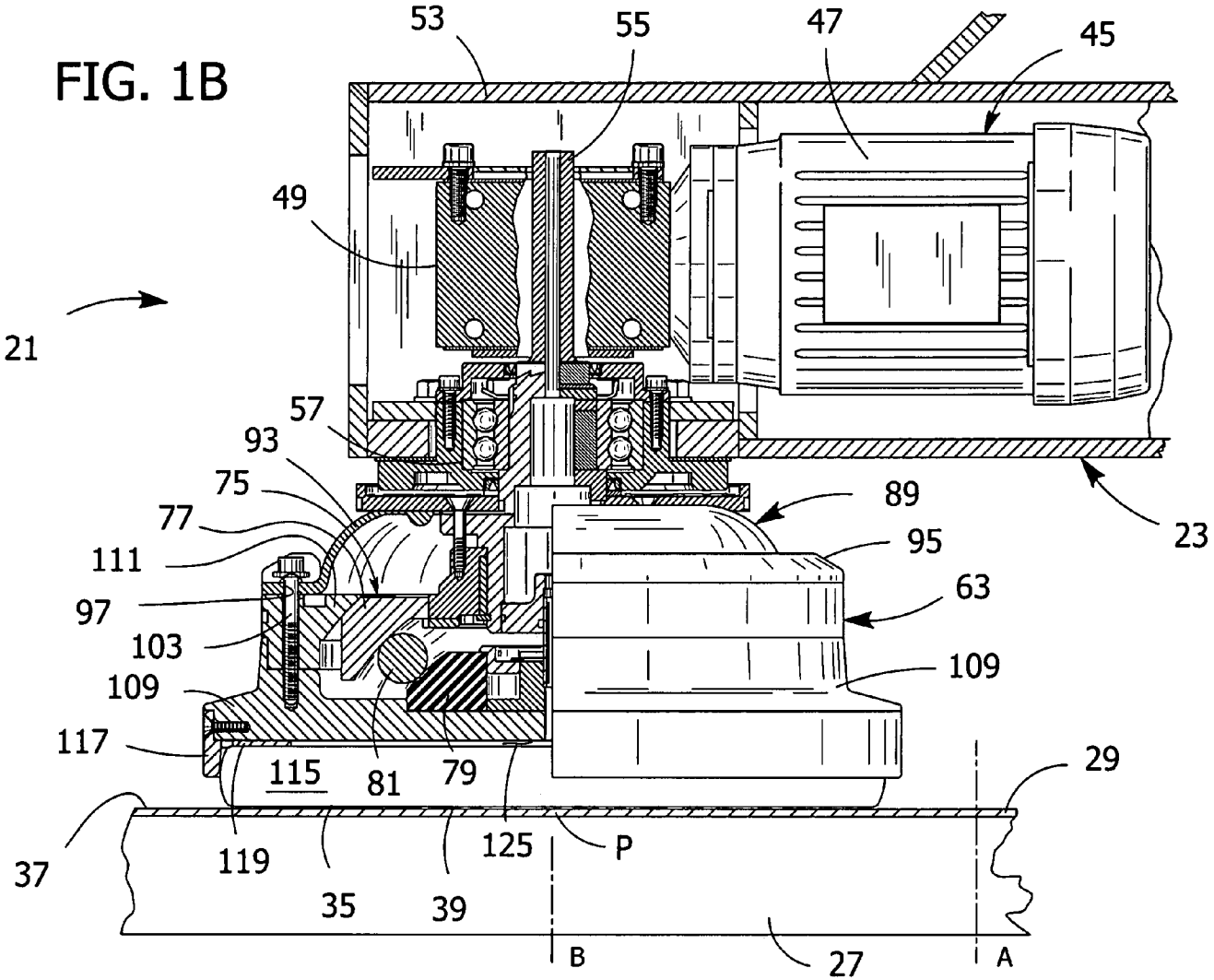
FIG. 1B is a schematic side elevation and partial section of the wafer polishing apparatus of the present invention.

Turning to the present invention, specifically to FIGS. 1A and 1B, a wafer polishing apparatus, generally indicated at 21, constructed according to the present invention is shown having a base, generally indicated at 23, for housing and-supporting other elements of the polishing apparatus. The base 23 may be of various configurations, but preferably is formed to provide a stable support for the polishing apparatus 21. In the preferred embodiment, a booth 25 encloses the wafer polishing apparatus 21 and inhibit airborne contaminants from entering the booth and contaminating the apparatus and articles to be polished. Except as pointed out hereinafter with regard to the way the wafer is held and polished by the polishing apparatus during polishing, the construction of the polishing apparatus is conventional. An example of such a conventional single-sided polishing apparatus of the type discussed herein is the Strasbaugh Model 6DZ, available from Strasbaugh Inc. of San Luis Obispo, Calif.

A turntable 27 is mounted on the base 23 for rotation with respect to the base. The turntable 27 is circular and has a polishing pad 29 mounted thereon for polishing a semiconductor wafer 35. The polishing pad 29 is preferably adhesive-backed for securing the pad to the turntable 27. The turntable and polishing pad 29 rotate conjointly relative to the base 23 about an axis A perpendicular to the turntable and polishing pad. The opposite side of the polishing pad comprises a work surface 37 engageable with a front surface 39 of the semiconductor wafer 35. During polishing, the polishing pad 29 is designed to receive a continuous supply of polishing slurry. The polishing slurry is delivered to the pad 29 via a slurry delivery system (not shown). Polishing pads 29, polishing slurry, and slurry delivery systems are well known in the relevant art. The rotation of the turntable 27 is controlled by a turntable motor and turntable control device (not shown). The turntable control device controls the rotational speed of the turntable 27 to further adjust the polishing of the wafer 35, as will be discussed in greater detail below. The turntable control device and motor are well known in the relevant art.

A drive mechanism, generally indicated at 45, is mounted on the base 23 above the turntable 27 for imparting rotational motion of the drive mechanism about an axis B substantially parallel to axis A of the turntable (FIG. 1B). The drive mechanism 45 comprises a motor 47 and a gearbox 49 housed in a movable arm 53. The movable arm 53 pivots both laterally and vertically, so that the arm can pick up, polish and release the semiconductor wafer 35, as will be described in greater detail below. The drive mechanism 45 also includes a control device (not shown) for controlling the rotational speed of the drive mechanism to enhance the polishing characteristics of the polishing process. The motor 47 is oriented horizontally within the arm 53 and connected to the gearbox 49, which comprises a suitable worm gear assembly (not shown), for converting the rotation of the motor about a horizontal axis into rotation of an output shaft 55 about axis B. The conversion of rotational motor 47 energy in a gearbox 49 is well understood in the art and will not be further described here. The output shaft 55 passes from the gearbox 49 down through a double-row radial bearing 57 for controlling shaft orientation.

The base 23, booth 25, turntable 27, and drive mechanism 45 are each well known in the art and comprise the basic elements of the single-side wafer polishing apparatus 21 noted above. The subject of the present invention is a new and useful improvement to such a polishing apparatus 21. Turning to the new and novel features of the present embodiment, the wafer polishing apparatus 21 further comprises a polishing head, generally indicated at 63, pivotably and rotatably connected to the drive mechanism 45 for driven rotation of the polishing head (FIG. 1B). The polishing head's 63 primary purpose is holding the wafer 35 securely during polishing so that the wafer may be polished evenly. The polishing head 63 mounts on the lower end of the output shaft 55 so that they rotate conjointly. Polishing heads 63 are conventionally used to perform single-side polishing, but suffer various drawbacks relating to the quality of the polished wafer 35. The polishing head 63 of the present embodiment avoids those drawbacks by further comprising a spherical bearing assembly, generally indicated at 75. The assembly comprises an upper bearing member 77, a lower bearing member 79 and a plurality of ball bearings 81. The upper bearing member 77 and lower bearing member 79 are not rigidly connected to one another and may move with respect to one another. The ball bearings 81 are engageable with the upper bearing member 77 and the lower bearing member 79 for relative movement between the members, so that the polishing head 63 may pivot relative to the drive mechanism 45. The bearings 81 are preferably held within a conventional bearing race (not shown), as is well understood in the prior art, for holding the bearings in position between the bearing members 77, 79. The upper bearing member 77 is rigidly mounted on the drive mechanism 45 while the lower bearing member 79 is rigidly mounted to the polishing head 63. The upper bearing member 77 and the lower bearing member 79 have spherically shaped bearing surfaces arranged so that the center of curvature of each spherical bearing surface corresponds to a gimbal point P. Any line normal to either bearing surface passes generally through the gimbal point P, the pivoting center of the assembly 75. Thus, the drive mechanism 45 and the polishing head 63 also pivot about the gimbal point P. In the preferred embodiment, the bearing members 77, 79 and ball bearings 81 are formed from hardened steel or other material capable of withstanding repeated pivoting motions of the polishing head 63 as it rotates. The surfaces are highly polished to inhibit wear debris generation and to minimize friction within the spherical bearing assembly 75 and create a highly smooth pivoting movement of the bearing assembly.

The arm 53 applies downward pressure to the polishing head 63 during wafer polishing (FIG. 1B). As stated previously, the arm 53 pivots vertically about a horizontal axis near the proximal end of the arm (not shown). A hydraulic or pneumatic actuation system is commonly used to articulate the polisher arm 53, although other articulation systems are contemplated as within the scope of the present invention. These systems are well known in the relevant art and will not be described in detail here. Downward force from the actuation system is transferred to the wafer 35 through the output shaft 55, the upper bearing member 77, the ball bearings 81, and the lower bearing member 79.

The wafer polishing apparatus 21 further comprises a semi-rigid connection, generally indicated at 89, between the drive mechanism 45 and the polishing head 63 for imparting a rotational force from the drive mechanism to the polishing head (FIG. 1B). The semi-rigid connection 89 ensures that the polishing head 63 and drive mechanism 45 rotate conjointly so the control device can regulate the speed of the drive mechanism, and thereby the rotation of the wafer 35. Without the semi-rigid connection 89, the upper bearing member 77 would rotate with the drive mechanism 45 while the lower bearing member 79 and wafer 35 would fail to rotate beneath the spherical bearing assembly 75. The connection between the drive mechanism 45 and the polishing head 63 must be semi-rigid so that the universal pivoting motion of the polishing head with respect to the drive mechanism about the spherical bearing assembly 75 is unaffected by the driving force of the drive mechanism. The semi-rigid connection 89 is a flexible connection, which in the first embodiment is a torque transmittal boot 93 attached to the drive mechanism 45 and the polishing head 63. The boot 93 allows the polishing head 63 to pivot with respect to the drive mechanism 45 about horizontal axes passing through the gimbal point P of the spherical bearing assembly 75 for transmitting the rotation from the drive mechanism to the polishing head. A ring 95 fits over the outer edge of the torque transmittal boot 93 to secure the boot to the polishing head 63. The ring 95 and boot 93 each contain a plurality of matching holes 97 so that a plurality of bolts 103 can pass through the ring and boot to firmly hold the boot to the polishing head 63. The ring 95 reenforces the boot 93 so that the rotational force transmitted through the boot spreads evenly over the circumference of the boot. In the preferred embodiment, the torque transmittal boot 93 is made of an elastomeric material, such as rubber (e.g., urethane), having a stiffness capable of transmitting the rotational energy of the drive mechanism 45 to the polishing head 63 and a resiliency capable of allowing pivoting movement of the polishing head. Other materials capable of transmitting the rotation energy and allowing pivoting motion of the polishing head 63 are also contemplated as within the scope of the present invention.

The polishing head 63 is further adapted to hold the wafer 35 for engaging the front surface 39 of the wafer with the work surface 37 of the polishing pad 29 (FIG. 1B). The head 63 includes a lower body 109 mounted on the lower bearing member 79. The lower body 109 rotates conjointly with the lower bearing member 79 and rigidly connects to the torque transmittal boot 93 as described above. Therefore, the boot 93 transfers the rotational energy of the output shaft 55 directly to the lower body 109 of the polishing head 63. The lower body 109 additionally includes an inwardly directed annular flange 111 which projects inward above the upper bearing member 77 so that when the arm 53 lifts the polishing head 63 upward, the weight of the lower body 109, a polishing block 115 and the wafer 35 rest upon the rigid upper bearing member, rather than the torque transmittal boot 93. This flange 111 helps preserve the torque transmittal boot 93 by not subjecting it to a repeated vertical tensile load when the arm 53 lifts the drive mechanism 45 and polishing head 63. The lower body 109 further comprises a retaining ring 117 and mounting shim 119 mounted beneath the lower body, cooperating to create a seat for the polishing block 115 to mount on the polishing head 63. The retaining ring 117 extends downward from the perimeter of the lower body 109 to provide lateral support for the polishing block 115, and the mounting shim 119 is a flat annular ring which mounts on the underside of the lower body to separate the block from the lower body. The polishing block 115 is a thick, rigid block used as support for the wafer 35 during polishing. Polishing blocks 115 are selected for their flatness and rigidity and are typically formed from ceramic materials due to their structural rigidity and temperature stability. The wafer 35 is mounted on the bottom of the polishing block 115 in a conventional manner by applying a wax layer to the polishing block and adhering the wafer to the block, leaving the front surface 39 of the wafer exposed and facing downward. The polishing block 115 is then mounted on the lower body 109 by evacuating a cavity 125 formed between the lower body, shim 119 and polishing block. Evacuating this cavity 125 holds the polishing block 115 securely on the polishing head 63.

Figure 2:
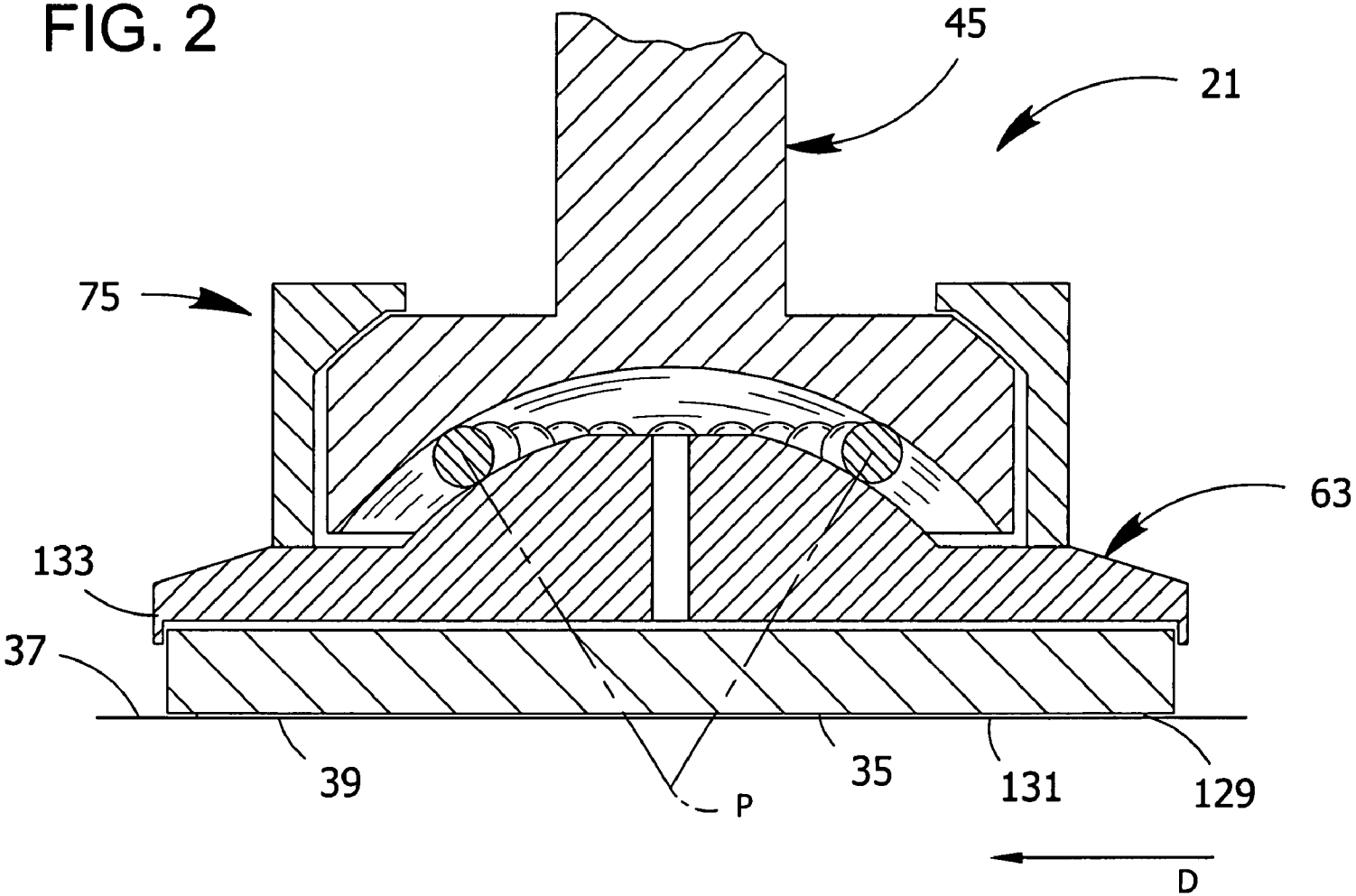
FIG. 2 is an enlarged, fragmentary schematic of the wafer polishing apparatus showing a polishing head thereof in section.

In operation, referring now to FIG. 2, the interaction of the polishing head 63 pivotably mounted on the drive mechanism 45 is depicted schematically. Arrow D indicates the direction of movement of the turntable 27 with respect to the wafer 35. As discussed previously, the gimbal point P is the pivoting point of the entire spherical bearing assembly 75. The location of this gimbal point P with respect to the wafer 35 impacts the polishing characteristics of the polishing apparatus 21. As the polishing pad 29 rotates beneath the polishing head 63, friction between the pad and the wafer 35 creates horizontal forces on the head, resulting in a moment on the head. By lowering the gimbal point P of the polishing head 63 toward the work surface 37, or slightly below the surface as shown in an exaggerated position in FIG. 2, the moment applied to the polishing head by frictional forces is either minimized or imparted in a more desirable direction. Control of this moment results in more uniform polishing pressure at all points on the wafer 35 and in more uniform wear of the polishing pad 29. Wafers 35 polished with a gimbal point P near or slightly below the work surface 37 exhibit superior flatness characteristics, particularly near an outer edge 129 of the wafer where conventional polishing processes exhibit characteristic "roll-off." Roll-off occurs in polishers having a gimbal point P' above the work surface 37 where the torque on the polishing head 63 due to friction presses the leading edge 131 of the wafer 35 into the polishing pad 29. Because the wafer 35 is rotating, the leading edge 131 of the wafer is constantly changing, creating a downwardly sloping edge, or roll-off, about the circumference of the wafer. Where the gimbal point P lies at the polishing interface, the moment decreases because the friction forces pass through or very near the gimbal point P. The leading edge 131 of the wafer 35 (or a retaining ring holding the wafer as discussed below) does not press the wafer 35 into the polishing pad 29 with as much force, decreasing wafer roll-off. In addition, less of the polishing slurry is pushed forward of the wafer 35 and squeezed off the pad 29 as the leading edge 131 of the wafer 35 moves across the polishing pad, as compared with typical polishers having a gimbal point P' further above the work surface 37. With more slurry flowing toward the wafer's 35 center, the center is subject to more polishing, further lessening the overpolishing of the wafer edge 129. Where the pivot point P is below the work surface 37, the moment reverses, biasing the polishing pressure to a trailing edge 133 of the head 63, further enhancing the amount of slurry able to flow beneath the wafer 35 and improving polishing of the central portion of the wafer.

In the present invention, the gimbal point P lies near the work surface 37 when the polishing head 63 holds the wafer 35 in engagement with the polishing pad 29. This location allows the wafer 35 to continuously align itself to equalize polishing pressure over the front surface 39 of the wafer, while the polishing head 63 is driven to rotate by the driving mechanism 45. Because of the pivoting motion of the polishing head 63, the front surface 39 is maintained in flatwise engagement with a work surface 37 for more uniform polishing of a semiconductor wafer 35. Moreover, by pivoting about a point P lying at the polishing interface, moments on the head 63 arising from friction forces directed parallel to the front surface 39 of the wafer 35 are virtually eliminated. In the preferred embodiment, the gimbal point P lies no higher than an interface of the wafer 35 and the work surface 37 on a side of the interface containing the turntable 27. This configuration maintains the work surface 37 and the front surface 39 in a nearly parallel relationship by equalizing polishing pressure over the front surface for more uniform polishing of the wafer 35. This configuration further inhibits pressure points from forming near the leading edge 131 of the wafer 35 due to pivoting of the head relative to the turntable 27. Because the moment on the polishing head 63 applies slightly more pressure to the trailing edge 133 of the wafer 35, an adequate amount of slurry can pass between the wafer and polishing pad 29 to improve wafer polishing.

The axis of rotation of the polishing head (axis B) is spaced apart from an axis of rotation (axis A) of the turntable (FIG. 1B). This helps ensure that the wafer 35 is subject to even polishing over a substantial portion of the polishing pad 29. The polishing pad is preferably much wider than the wafer 35 and polishing head 63, so that no portion of the wafer passes over the central portion of the polishing pad during polishing. This helps increase the longevity of the polishing pad 29 and the evenness of the wafer polish, because the wafer 35 interacts with a majority of the polishing pad.

Figure 2A:
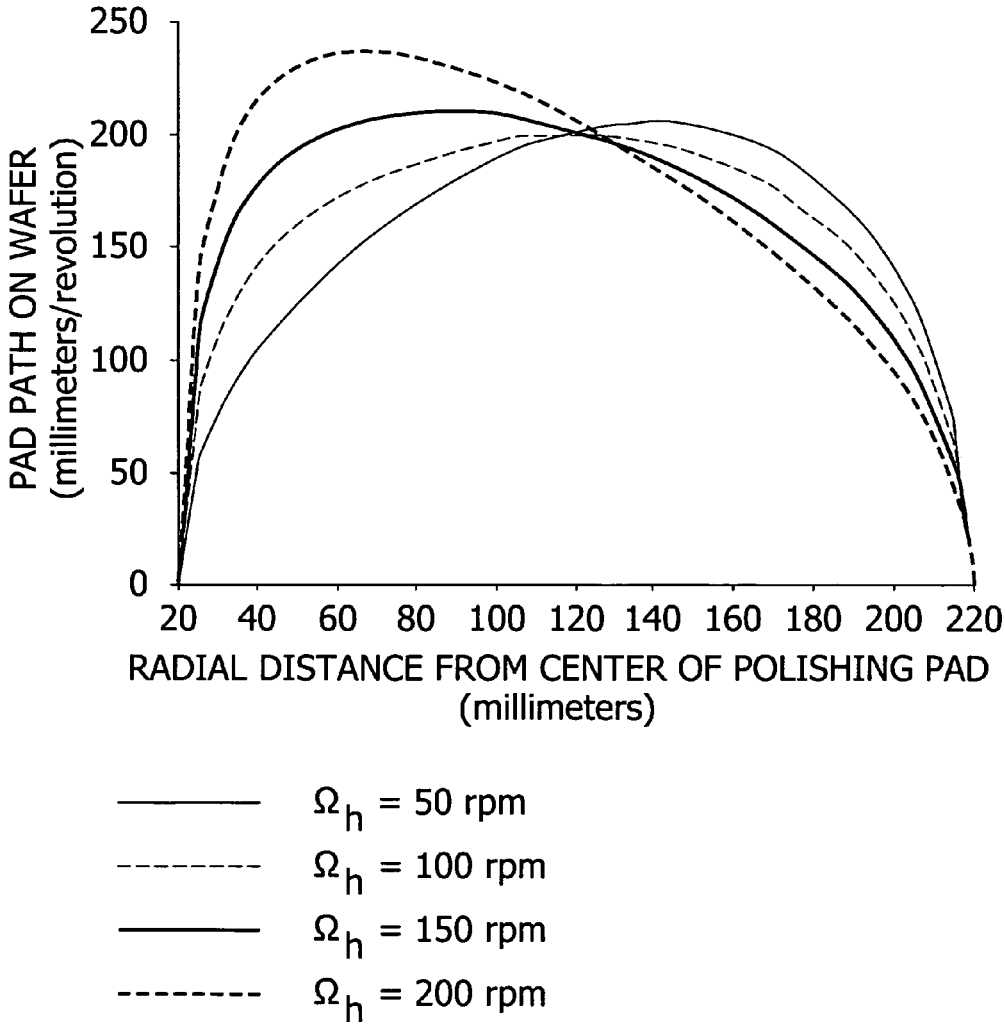
FIG. 2A is graph depicting a comparison of the total linear distance the wafer travels over each point on the polishing pad for different polishing head rotational speeds.

Additionally, the polishing head 63 and the turntable 27 rotate at different relative rotational speeds for more uniform and efficient polishing of the wafer 35. Regulating the rotational speed of the polishing head 63 impacts the wear pattern of the polishing pad 29, which in turn impacts wafer 35 flatness and polishing pad life. The rotation of the wafer 35 and the polishing pad 29 can be modeled mathematically to compare the relative velocities of each for determining what relative velocities will likely provide the most even polishing and longest pad life. FIG. 2A is a graphical depiction of the results of such a comparison. The set of curves on FIG. 2A depict the total linear distance the wafer 35 travels over each point on the polishing pad 29. Each curve represents a different rotational speed ($\Omega_h$) of the polishing head 63, while the rotational speed of the polishing pad 29 is held at a constant 200 revolutions per minute (rpm). For example, where the polishing pad 29 and polishing head 63 rotate at the same rotational speed, 200 rpm ($\Omega_h$=200 rpm), any point on the polishing pad lying 60 millimeters (2.4 inches) from the center of the pad sees approximately 235 millimeters (9.25 inches) of wafer 35 pass over that point during each revolution of the polishing pad. Tracing the curve corresponding to a polishing head speed of 200 rpm ($\Omega_h$=200 rpm), FIG. 2A demonstrates that where the polishing pad 29 and polishing head rotate at the same speed, the radially inner portions of the polishing pad see more linear distance of wafer 35 pass over them than the outer portions of the polishing pad. Over time, this could lead to greater polishing pad 29 wear near the inner portion of the polishing pad 29. Ideally, each point on the polishing pad 29 should see an identical amount of wafer 35 pass over during a single revolution. But it is apparent from FIG. 2A that no combination of angular velocities would produce such a resulting horizontal line. The best available profile would distribute the wafer 35 distance seen by each portion of the pad 29 more evenly over the whole polishing pad. The curve where the polishing head 63 rotates at a speed of 100 rpm ($\Omega_h$=100 rpm) nearly approximates such a result. Therefore, rotating the polishing head 63 near about 100 rpm often yields more even polishing of the wafer 35 and more consistent wear over the polishing pad 29, because pad wear may be inferred from linear wafer distance seen by the polishing pad. Because these results are based upon relative velocities, they are scalable and the velocity of the polishing head 63 may be expressed as a percentage of the rotational velocity of the polishing pad 29.

As discussed above, in the preferred embodiment, the polishing head 63 is driven at a rotational speed less that the turntable 27. Were the wafer 35 and polishing head 63 allowed to freely rotate, they would rotate at approximately the same speed as the polishing pad 29, leading to uneven wear of the pad. Thus, the drive mechanism 45 actually throttles the rotational speed of the polishing head 63 so that the polishing head rotates at a rotational speed of between about forty percent (40%) and about seventy percent (70%) of the rotational speed of the turntable 27. In the example above, this corresponds to an $\Omega_h$ of between 80 rpm and 140 rpm. Based upon further experimentation and the above analysis, this range has been found to be the optimal range for wafer polishing, producing more uniform polishing across the front surface 39 and more even polishing pad 29 wear. More particularly, the best polishing is achieved where the drive mechanism 45 rotates at a rotational speed of about fifty-five percent (55%) of the rotational speed of the turntable 27. In the example of FIG. 2A, this corresponds to an $\Omega_h$ of approximately 110 rpm.

Figure 3:
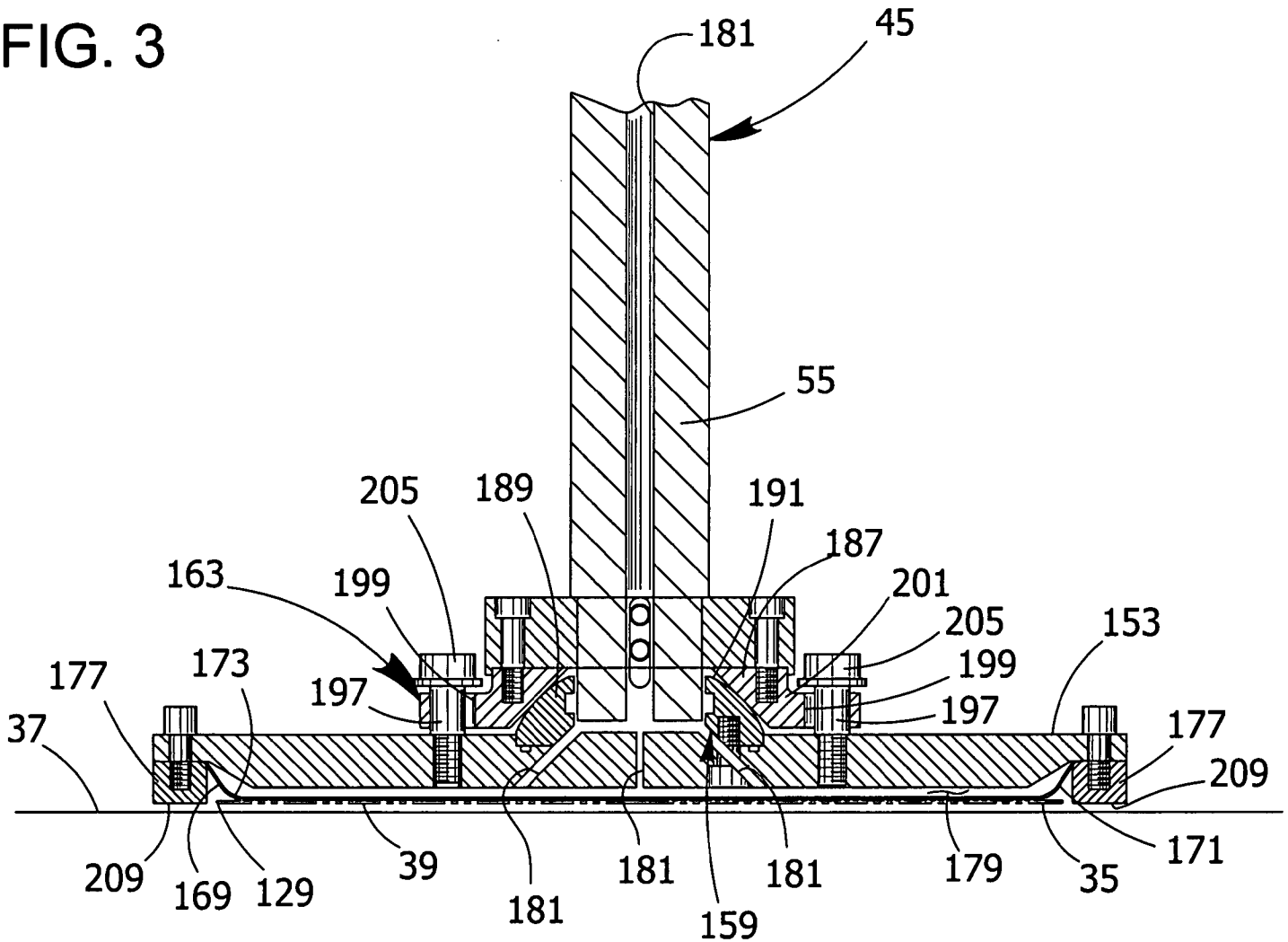
FIG. 3 is an enlarged, fragmentary section of a second embodiment of the polishing head of the present invention.

Turning to a second embodiment of the polishing head of the present invention, a polishing head 153 connects to the drive mechanism 45 for driven rotation of the polishing head (FIG. 3). The polishing head 153 is adapted to hold a wafer 35 for engaging a front surface 39 of the wafer with a work surface 37 of the polishing pad 29. The polishing head 153 is attached to the drive mechanism 45 via a spherical bearing assembly, generally indicated at 159, for pivoting of the polishing head about a gimbal point lying near the work surface 37. The polishing head 153 holds the front surface 39 of the wafer 35 in engagement with the polishing pad 29, thereby polishing the wafer and allowing the plane of the front surface to continuously align itself to equalize polishing pressure over the front surface of the wafer for more uniform polishing of a semiconductor wafer.

A semi-rigid connection, generally indicated at 163, attaches to the drive mechanism 45 and the polishing head 153 for transferring a rotational force from the drive mechanism to the polishing head, while permitting universal pivoting motion of the polishing head with respect to the drive mechanism about the spherical bearing assembly 159. In many facets, therefore, the second embodiment is similar to the first.

Although similar, the second embodiment of the polishing head 153 retains the wafer 35, imparts pressure on the wafer and transmits rotation to the polishing head in novel ways. A membrane 169 is mounted on the underside of the polishing head 153 (FIG. 3). In the preferred embodiment, the membrane 169 is formed from silicone, although other suitable materials are contemplated as within the scope of the present invention. The membrane 169 has an outer surface 171 engageable with the wafer 35 for mounting the wafer on the polishing head 153 and an inner surface 173 opposite the outer surface facing the polishing head. The polishing head 153 further comprises a ring-shaped retainer 177 that encircles the membrane 169 and attaches to the polishing head to retain the membrane on the head. The retainer 177 seals the periphery of the membrane 169 to the polishing head 153, while allowing the portion of the membrane not directly engaging the retainer to move independently inward and outward from the head a short distance. A cavity 179 defined between the membrane 169 and the head 153 is in fluid communication with a vacuum source. The vacuum is transmitted to the polishing head 153 by passing through a series of channels 181 in an output shaft 55 and head. The membrane 169 has a hole formed therein so that when a vacuum is drawn in the cavity 179, the membrane 169 can draw the wafer 35 up against the membrane and hold the wafer. The membrane 169 further holds the wafer by selectively varying air pressure within the cavity 179 for pressing the front surface 39 uniformly against the work surface 37. Although the second embodiment is capable of performing substantially identical polishing as the first embodiment, the second embodiment is ideally suited for polishing a wafer 35 previously polished on a double-side polished wafer polisher. Such a wafer 35 is already polished substantially flat, so that any additional polishing is aimed at removing a uniform layer of silicon material over the entirety of the wafer, without generally impacting wafer flatness. The membrane 169 is particularly well suited for such a purpose, as the retainer 177 is pressed firmly against the polishing pad 29 for retaining the wafer 35 while the membrane allows the wafer to conform to the polishing pad for removal of a uniform layer of silicon.

The spherical bearing assembly 159 further comprises an upper conical seat 187 attached to and rotating with the drive mechanism 45 (FIG. 3). A lower spherical pivot 189 rigidly mounts on the polishing head 153 and extends upward toward the drive mechanism 45. The lower spherical pivot 189 is engageable with the upper conical seat 187 for pivotable movement of the polishing head 153 with respect to the drive mechanism 45. The lower spherical pivot 189 has an upwardly directed spherical face 191. Any line normal to the spherical face 191 passes through the gimbal point of the pivot. Although the construction of the spherical bearing assembly 159 is substantially different than the first embodiment, the pivoting motion created is substantially similar, resulting in uniform pressure of the retainer 177, and a polished wafer 35 wherein a uniform layer of silicon is removed. As with the previous embodiment, the gimbal point lies at or slightly below an interface of the wafer 35 and the work surface 37 on a side of the interface containing the turntable 27. This geometry maintains the work surface 37 and the retainer 177 in flatwise engagement with a uniform distance between the front surface 39 and the work surface for more uniform pressure of the retainer. This configuration inhibits low pressure points from forming near the trailing edge of the retainer 177 due to pivoting of the polishing head 153 relative to the turntable 27, helping retain the wafer. Preferably, the lower spherical pivot 189 is formed from a high strength metal, such as stainless steel, and the upper conical seat 187 is formed from a plastic material, such as PEEK, a polyaryletherketone resin, available from Victrex USA Inc. of Westcheter, Pa., U.S.A. Both surfaces are highly polished to inhibit wear debris generation and to minimize friction within the spherical bearing assembly 159 and create a highly smooth pivoting movement of the bearing assembly.

In the second embodiment, the semi-rigid connection 163 comprises a plurality of shoulder bolts 197 attached to the polishing head 153 (FIG. 3). These shoulder bolts 197 extend upward from the polishing head 153 and pass through a series of radial slots 199 in an annular flange 201 extending laterally from the upper conical seat 187. The radial slots 199 are sized slightly larger than the bolts 197 so that as the drive mechanism 45 rotates, the radial slots engage the shoulder bolts for inducing rotation of the polishing head 153. The additional clearance between the radial slots 199 and the bolts 197 allows the upper conical seat 187 and the lower spherical pivot 189 to pivot slightly with respect to one another and prevents the wafer 35 from falling out of the head 153 and reduces wear on retainer 177. As with the previous embodiment, this pivoting allows for more uniform polishing and continuous transmission of rotation from the drive mechanism 45 to the polishing head 153. The flange 201 and upper conical seat 187 are of unitary, plastic construction. When the drive mechanism 45 is lifted upward after polishing, a bolt head 205 of each of the shoulder bolts 197 engages the plastic flange 201, such that the polishing head 153 is lifted from the work surface 37.

Applying polishing pressure through a membrane 169 has advantages over a polisher with using a rigid surface to support a wafer 35 during polishing. First, the head 153 can retain the wafer 35 without the use of an adhesive, reducing complexity and eliminating a possible contaminant. This embodiment secures the wafer 35 to the head 153 with a vacuum, eliminating one source of potential contamination. Second, because the polishing pressure is applied to the wafer 35 via a membrane 169, any particulate matter inadvertently caught between the wafer 35 and the membrane 169 will not affect the polished surface. With conventional systems, particulate matter, can become lodged between the wafer 35 and the rigid support surface (e.g., backing plate). During polishing, this matter puts pressure on the back surface of the wafer, thereby pushing a small portion of the wafer outward toward the polishing pad. The polishing operation seeks to flatten the wafer, and typically flattens this small portion of the wafer pushed outward by the foreign matter. Once the wafer is removed from the rigid support, the portion of the wafer pushed out by the dust returns to its original position, leaving a dimple defect in the polished surface. With a membrane 169, any particulate matter lodged between the membrane and the wafer 35 will temporarily deform the membrane, not the wafer, allowing the wafer to be polished normally without dimpling the wafer.

In operation, the wafer 35 and retainer ring 177 both engage the work surface 37 (FIG. 3). As the polishing head 153 rotates, the membrane 169 presses the wafer 35 into the work surface 37 while the ring 177 retains the wafer 35 within the head so that the friction between the work surface and the wafer cannot pull the wafer out of the head. The retainer 177 will wear slightly after extensive use, so that an offset between a bottom 209 of the retainer and the membrane 169 may be maintained. In effect, the ring 177 holds the polishing head 153 at the proper distance from the work surface 37 while the membrane 169 presses the wafer 35 into the work surface. By encircling the wafer 35 and extending downward from the polishing head 153 adjacent the wafer, the retainer 177 engages the wafer's edge 129 during polishing, even with some wear of the retainer over time. As with the first embodiment, the polishing head 153 and the turntable 27 rotate at different relative rotational speeds for more uniform polishing of the wafer 35. The polishing head 153 rotates at a rotational speed less that the turntable 27. Preferably the drive mechanism 45 rotates the head 153 at a rotational speed of between about forty percent (40%) and, about seventy percent (70%) of the rotational speed of the turntable 27. When the polishing head 153 rotates at a rotational speed of about fifty-five percent (55%) of the rotational speed of the turntable 27, the polisher produces optimally flat wafers.

Figure 4:
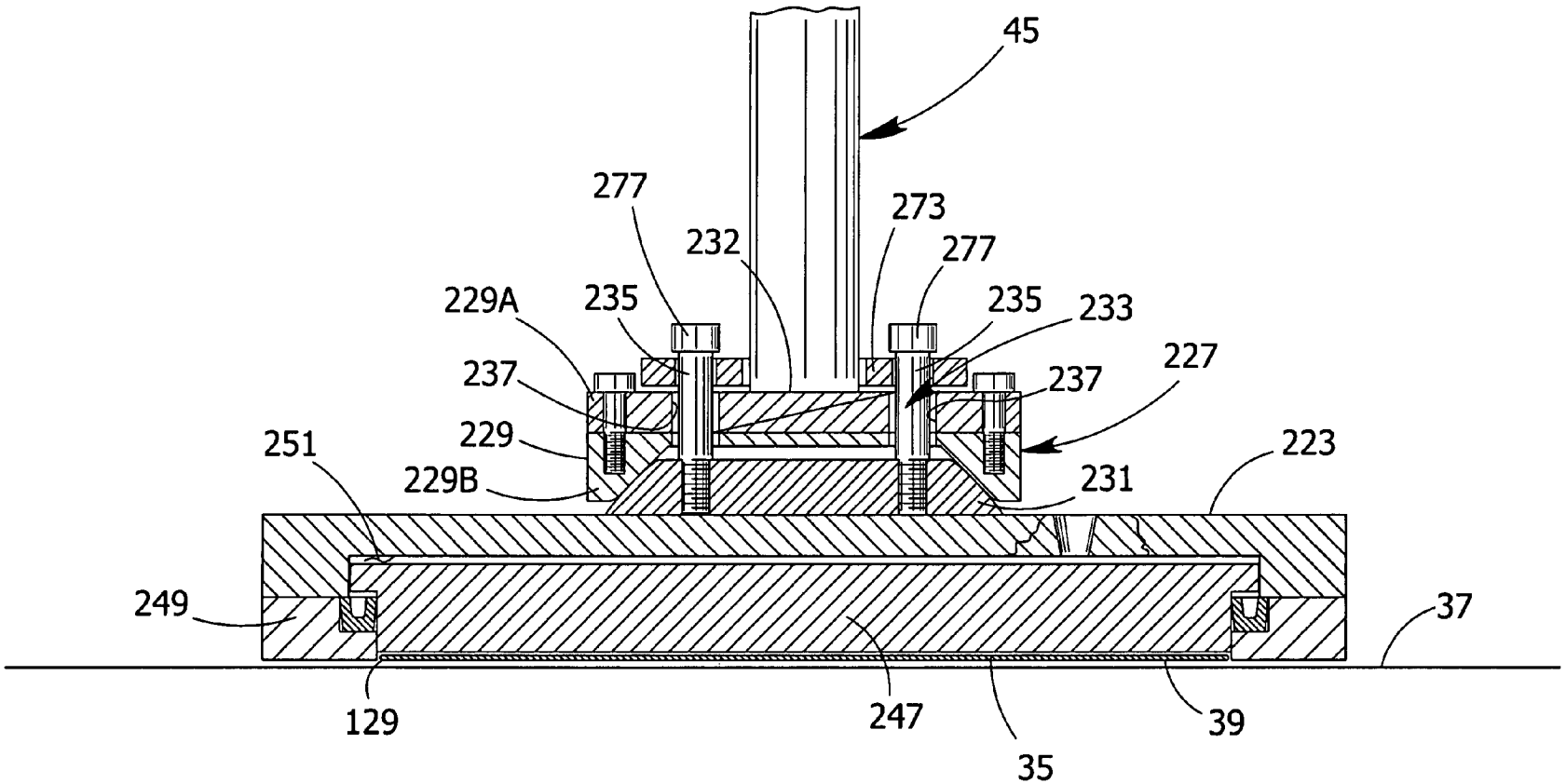
FIG. 4 is an enlarged, fragmentary section of a third embodiment of the polishing head of the present invention.

Turning to a third embodiment of the polishing head, the present embodiment comprises a polishing head 223 connected to the drive mechanism 45 for driven rotation of the polishing head (FIG. 4). The polishing head 223 is adapted to hold a wafer 35 for engaging a front surface 39 of the wafer 35 with a work surface 37 of the polishing pad. Like the previous embodiment, the present embodiment is directed to providing uniform pressure over the wafer 35 for removal of a uniform layer of silicon from a wafer made flat by a double-side polishing process or a fine grinding process.

A spherical bearing assembly, generally indicated at 227, connects the polishing head 223 and the drive mechanism 45 for pivoting of the polishing head. The spherical bearing assembly further comprises an upper conical seat 229 and a lower spherical pivot 231, similar to the second embodiment. The upper conical seat 229 is preferably welded to the drive mechanism 45 along a distal end 232 of the drive mechanism, although other permanent forms of attachment are also contemplated as within the scope of the present invention. The polishing head 223 pivots about a gimbal point lying no higher than the work surface 37 when the polishing head holds the wafer 35 in engagement with the polishing pad, thereby allowing the plane of the front surface 39 of the wafer to continuously align itself to equalize polishing pressure over the front surface of the wafer, while rotation of the polishing head is driven by the driving mechanism 45. Preferably, as with the previous embodiments, the gimbal point lies below an interface of the wafer 35 and the work surface 37 on a side of the interface containing the turntable 27 to equalize polishing pressure over the front surface 39 of the wafer. A uniform pressure is maintained between the front surface 39 and the work surface 37 for more uniform polishing of the wafer by inhibiting pressure points from forming near the edge 129 of the wafer 35 due to pivoting of the polishing head 223 relative to the turntable 27.

A semi-rigid connection, generally indicated at 233, between the drive mechanism 45 and the polishing head 223 transmits the rotational force of the drive mechanism to the polishing head while permitting universal pivoting motion of the polishing head with respect to the drive mechanism. This connection 233 is similar to the semi-rigid connection 163 of the second embodiment (FIG. 3) in that it uses shoulder bolts 235 mounted on the polishing head 223 and passing through holes 237 in the upper conical seat 229. In contrast, however, the upper conical seat 229 is not of unitary construction. The conical seat 229 includes a base **229*a*, welded to and extending laterally from the drive mechanism 45 to engage the shoulder bolts 235, while a portion 229*b* of the upper conical seat 229 extends downwardly from the base to engage the lower spherical pivot 231. The base 229*a* is preferably formed from metal so that it may be welded to the drive mechanism 45. The portion 229*b* is preferably formed from a plastic material, such as PEEK, a polyaryletherketone resin available from Victrex USA Inc. of Westcheter, Pa., U.S.A. Both the upper conical seat 229 and the lower spherical pivot 231 are highly polished to inhibit wear debris generation and to minimize friction within the spherical bearing assembly 227** and create a highly smooth pivoting movement of the bearing assembly.

An important distinction between the second and third embodiments is the method of applying polishing pressure to the wafer 35. The third embodiment does not employ a membrane 169 but uses a rigid backing plate 247 and a retainer 249, both attached to the polishing head 223, to retain the wafer 35. The backing plate 247 is flat and rigid, similar to a polishing block 115 of the first embodiment, being adapted to apply uniform pressure over the entire wafer 35 for even polishing of the wafer. Air pressure maintained within a cavity 251 formed between the polishing head 223 and the backing plate 247 exerts downward force on the backing plate and wafer 35. The retainer 249 extends downward from the polishing head 223 below the backing plate 247 for retaining the wafer 35 during polishing, similar to the second embodiment. The backing plate 247 moves independently of the retainer 249 so that as the retainer wears, the backing plate will extend outward a correspondingly smaller distance for maintaining the same distance between the backing plate and retainer. This ensures that the proper engagement depth is maintained between the retainer 249 and the wafer 35 for retaining the wafer within the retainer during polishing. When elevating the polishing head 223 from the work surface 37, both before and after polishing, the drive shaft 45 first lifts the spherical bearing assembly 227. A lift washer 273 fits loosely over the drive mechanism 45 and the shoulder bolts 235 so that as the drive mechanism lifts the polishing head 223, the shoulder bolt heads 277 rest against the washer so that the drive mechanism can lift the polishing head. Without the lift washer 273, the heads 277 could pass through the holes 237, preventing lifting of the polishing head from the work surface 37. The loose fit of the lift washer 273 over the shoulder bolts 235 and drive mechanism 45 ensures that the washer does not impact the polishing process by inhibiting the gimbal action.

In operation, the third embodiment is virtually identical to the previous two embodiments. This includes controlling the rotational speed of the drive mechanism 45 relative to the turntable 27. The same speed range applies (between about forty percent (40%) and about seventy percent (70%)) and optimal rotational speed of about fifty-five percent (55%).

Figure 4A:
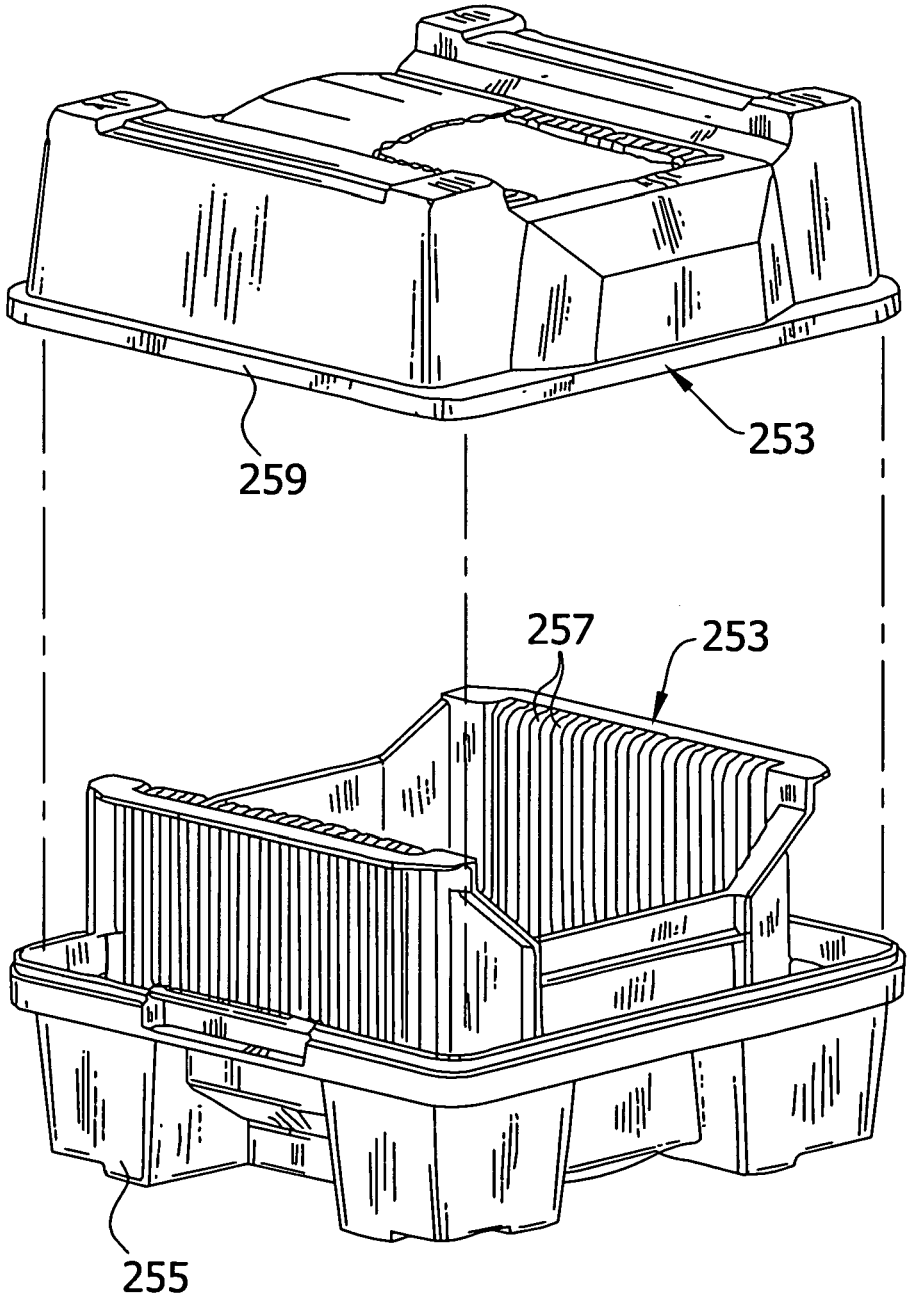
FIG. 4A is a perspective view of a wafer carrier.

The present invention is additionally directed to a group of single side polished, monocrystalline semiconductor wafers 35 polished on a wafer polishing apparatus as described above in the first embodiment. Such wafers 35 are typically held in a cassette, generally indicated at 253 (FIG. 4A), for storage and transfer a plurality of wafers. Cassettes 253 typically include a bottom portion 255, wafer slots 257 and a lid 259. After manufacture, a set of individual wafers 35 is typically loaded into the cassette 253 for storage or shipping. These cassettes 253 can be of various sizes for holding any number of wafers, such as 25, 20, 15, 13, or 10 wafers per cassette. The wafers 35 are preferably formed from monocrystalline silicon, although the polishing apparatus and method of the present invention are readily adaptable to polishing other materials. The front surface 39 of a wafer 35 is polished to a finish polish, while the back surface of the wafer is not polished to a finish polish. Most wafers 35 additionally have a small chord of material, or a notch, removed from one edge 129 of the wafer, although the illustrated wafer exhibits no such chord.

Figure 5:
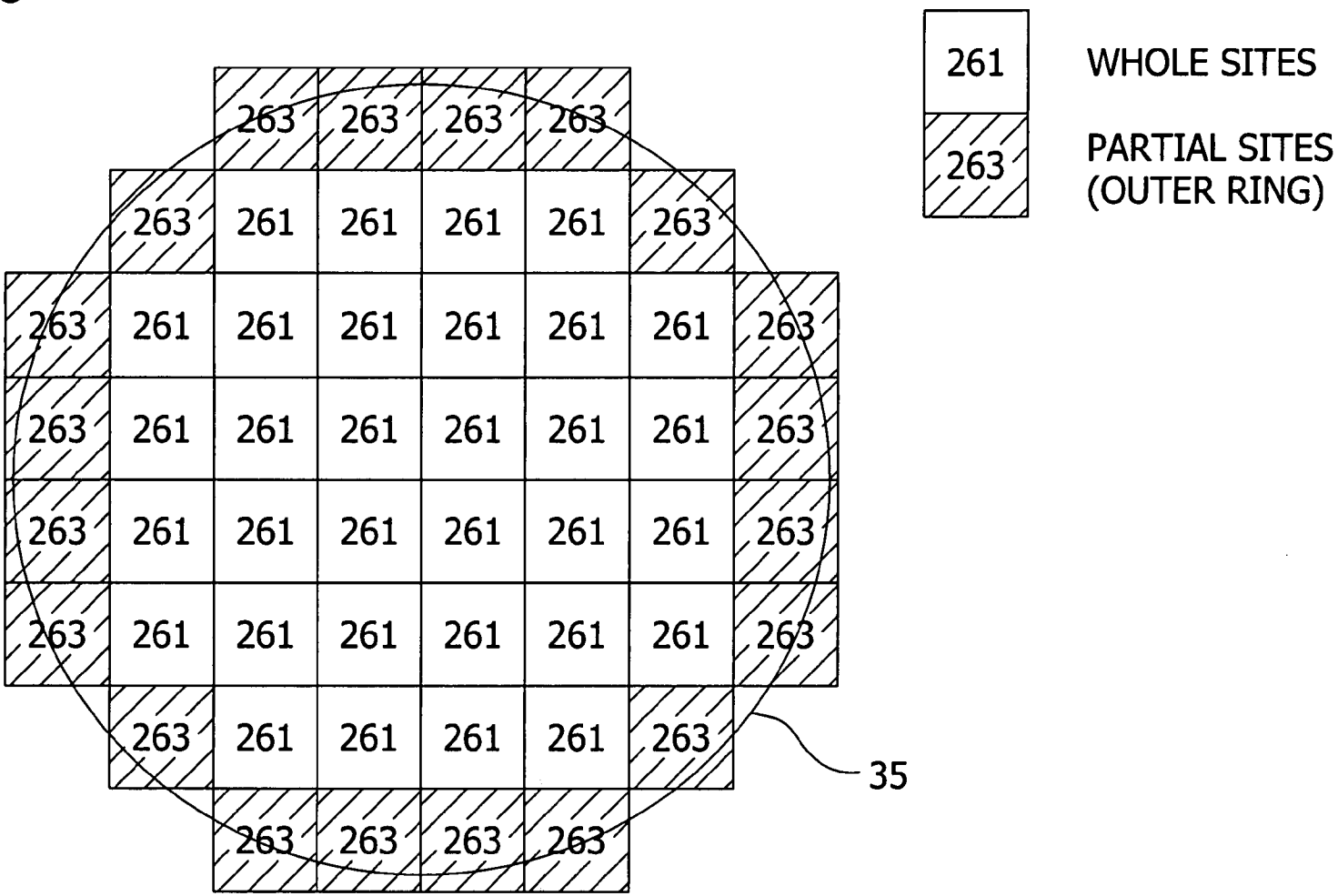
FIG. 5 is a schematic of a 200 millimeter (7.9 inches) diameter wafer divided into sites.

The front surface 39 of the wafers 35 are uniformly flat for use in lithographic imprinting of circuits. Wafers 35 polished according to the present invention have a usable front surface 39 over an area from the central axis at least to within 2 millimeters (0.08 inches) of the circumferential edge 129. Wafers are typically divided for analysis by projecting a grid of sites onto the front surface 39, as shown in FIG. 5. An outline of a semiconductor wafer 35 is shown. Any predetermined number, geometrical size or geometrical shape of sites may be overlain on the front surface 39 of the wafer, depending upon the wafer's application. Most commonly the sites are squares or rectangles of uniform size and shape. Some sites are categorized as whole sites 261 and others as partial sites 263. For the present analysis, a multiplicity of whole sites 261 lie entirely within the front surface 39 of the wafer 35 and a multiplicity of partial sites 263 lie partially on the front surface and partially outside the circumferential edge 129 of the wafer. When polished according to the present invention, the flatness of the partial sites 263 is substantially the same as the flatness of the whole sites 261. For purposes of discussion, the following data analysis is based upon semiconductor wafers 35 having a diameter of approximately 200 millimeters (7.9 inches) with a projected grid of twenty partial sites 263 and thirty-two whole sites 261, as shown in FIG. 5. The wafers used in this analysis were not selected according to their flatness, but represent a typical production grouping of wafers. Each site is preferably square in shape, measuring 25 millimeters (0.98 inches) along each side thereof. This corresponds to an area of each whole site 261 or each partial site 263 of about two percent (2%) of the area of the front surface 39 of the wafer. The partial sites 263 situated near the wafer's 35 edge 129 additionally comprise an outer ring of sites that are subject to improvement due to the present invention. Although the data analysis is based upon measurements from 200 millimeter (7.9 inch) wafers, the present invention is readily applicable to wafers of other diameters, such as 100 millimeter (3.9 inch), 150 millimeter (5.9 inch) and 300 millimeter (12 inch) wafers, to name a few.

Single side polished wafers 35 polished according to the present invention will exhibit partial sites 263 with uniform flatness substantially similar to the whole sites 261. This is a substantial improvement over single side polished wafers 35 polished on conventional polishers which often exhibit unacceptable roll-off near the edge 129 of the wafer. The front surface 39 of the wafer 35 of the present invention is a highly polished surface that is uniformly flat across the majority of the front surface, including a wafer surface area up to within about 2 millimeters (0.08 inches) of the wafer's circumferential edge 129. Typically, roll-off degrades the flatness of the wafer's 35 edge 129 enough to make the wafer usable for lithographic processing from a central axis to within 3 millimeters (0.12 inches) of the wafer's edge. Broadening a wafer's 35 usable area from 3 millimeters (0.12 inches) to within 2 millimeters (0.08 inches) of the wafer's 35 edge 129 increases the usable wafer area by two percent (2%). It is believed that the usable area extends closer to the edge than 2 millimeters (0.08 inches). More importantly, the partial sites 263 near the wafer's 35 edge 129 exhibit better flatness characteristics, so that lithography of these partial sites is more likely to create an accurate lithograph on the wafer. Better focused edge lithography yields fewer edge defects, translating into fewer device failures. Moreover, wafers 35 of the present invention are more symmetrical about the circumference of the wafer. More symmetrical wafers 35 are beneficial because they allow for uniform processing of all portions of a wafer.

Figure 6:
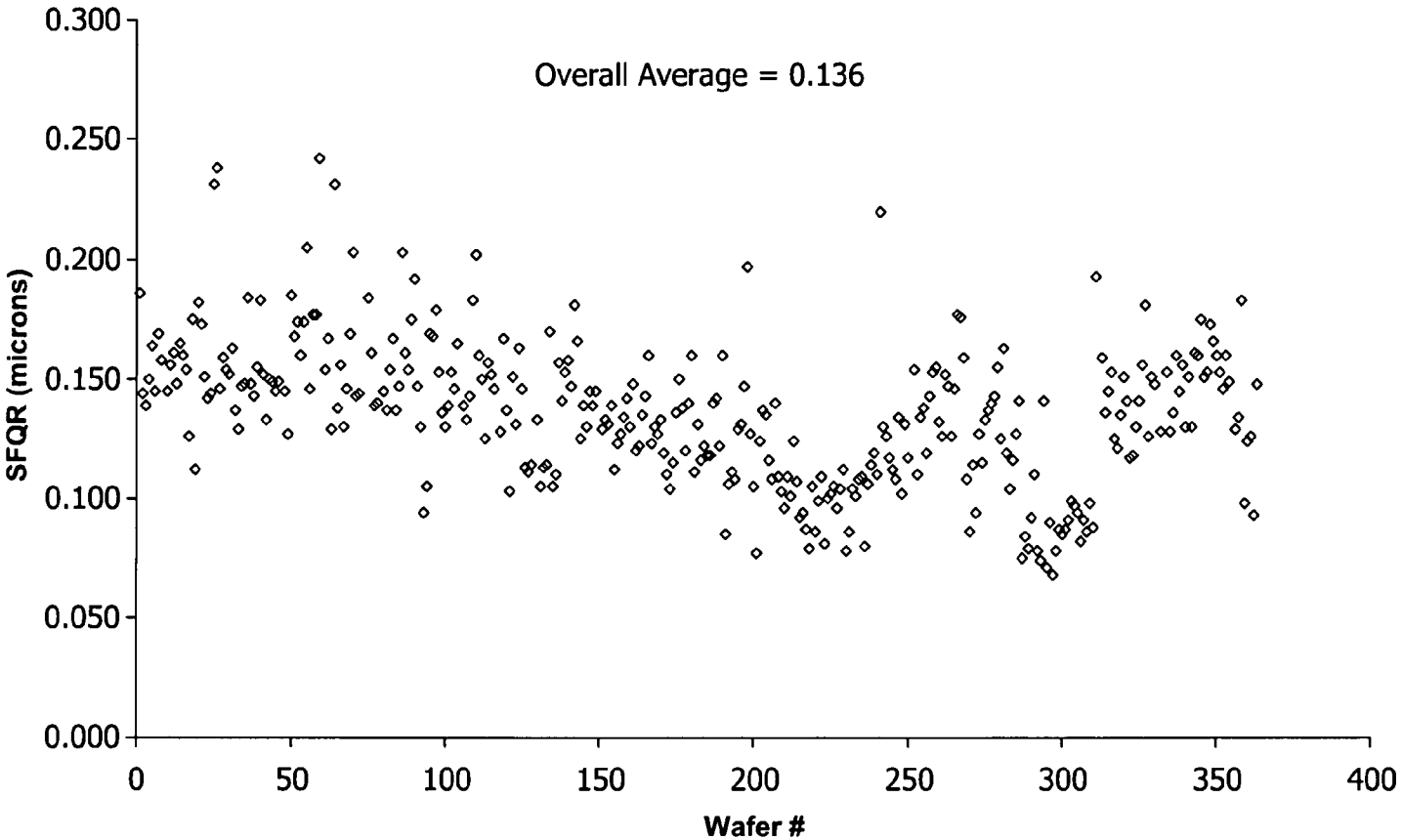
FIG. 6 is a graph depicting the largest SFQR value for any partial site on each wafer of a set of wafers polished on a conventional wafer polisher.
Figure 7:
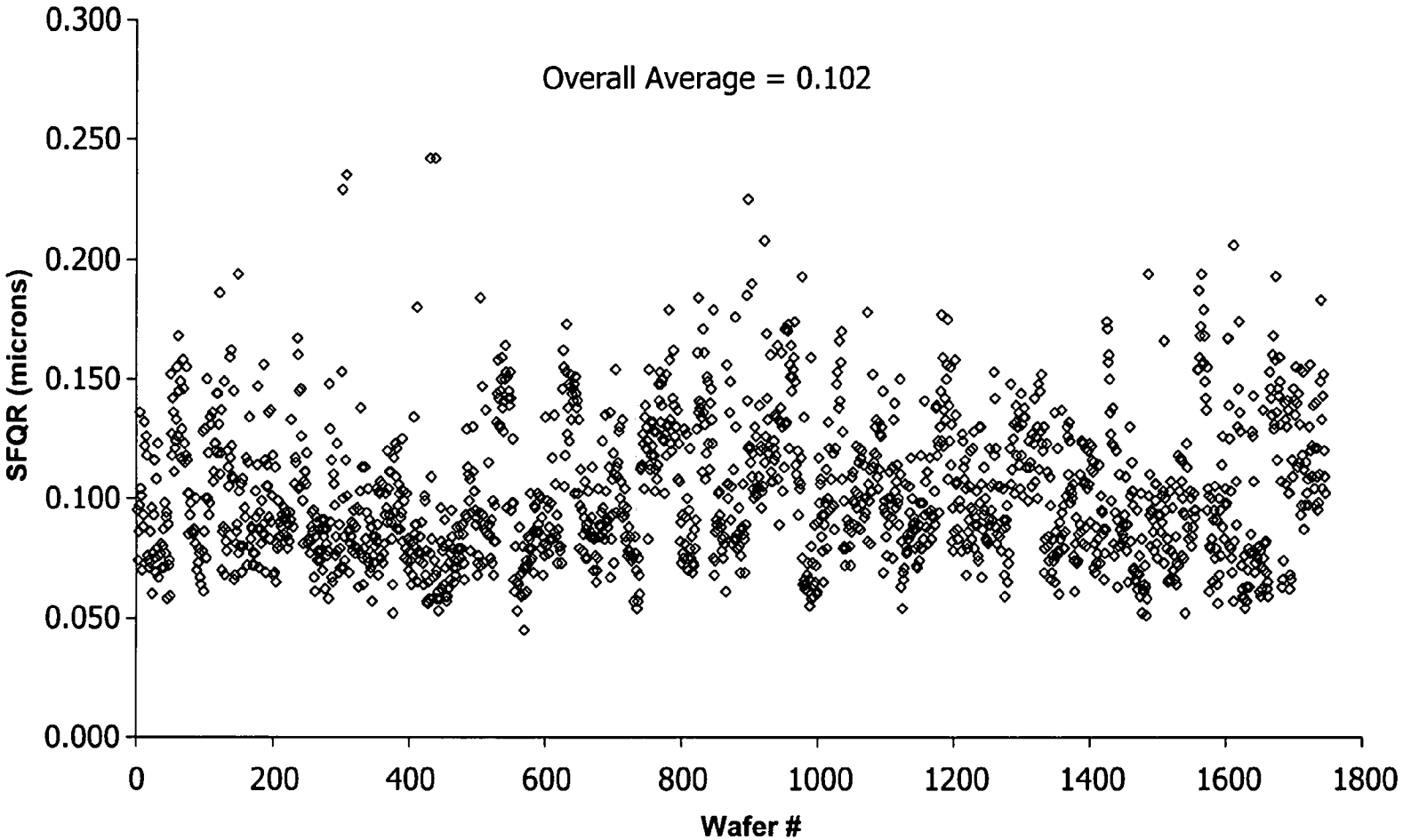
FIG. 7 is a graph depicting the largest SFQR value for any partial site on each wafer of a set of wafers polished on a wafer polisher of the present invention.

For example, FIG. 6 depicts a population of 200 millimeter (7.9 inch) diameter wafers polished on a conventional single-side polisher having a gimbal point approximately 51 millimeters (2.0 inches) above the work surface. The data was processed with a 2.0 millimeter (0.079 inch) edge exclusion, partials active and dimples included. In addition, sites 25 millimeters (0.98 inches) square were used to gather and interpret the flatness data. Particular wafers were dropped from the data set as unacceptable for sale, and thus for analysis, if any single site on a wafer had an SFQR value of greater than 0.250 microns (9.84 microinches). These wafers 35 are presumed to exhibit dimpling defects. Of the original 363 wafers in the sample, 15 were dropped, leaving 348 wafers and 348 data points. These data closely conform to historical performance of conventional single-side wafer polishers. A single data point is plotted from each wafer representing the largest SFQR value for any partial site 263 on the wafer, as measured with an industry-standard capacitance tool, rather than an emerging technology optical tool. For example, the data disclosed herein were gathered with an Ultrascan 9000 Series (e.g., Ultrascan 9600) manufactured by ADE Corporation of Westwood, Mass. These data points are plotted in FIG. 6 and yield an average of 0.136 microns (5.34 microinches) for the largest SFQR partial site 263 over the entire population of wafers. To compare this conventionally polished population to the present invention, FIG. 7 depicts a population of wafers polished on a wafer polisher of the present invention having a driven polishing head and a gimbal point at the interface of the front surface 39 of the wafer and the work surface. The wafers 35 were of the same size and processed in the same way except for the polishing step. Of the original 1745 wafers in the sample, 86 wafers were dropped for having any site on a wafer with an SFQR value of greater than 0.250 microns (9.84 microinches), again presumably because of dimpling, leaving 1659 wafers and 1659 data points. These data yield a smaller population average of 0.102 microns (4.02 microinches), an improvement of 24.8 percent (24.8%) over the conventional process. Therefore, a wafer polished according to the present invention should yield a maximum partial site 263 SFQR on average of less than about 0.105 microns (4.13 microinches). These wafers exhibiting improved flatness allow for accurate lithography of substantially the entire front surface 39 of the wafer.

Figure 8:
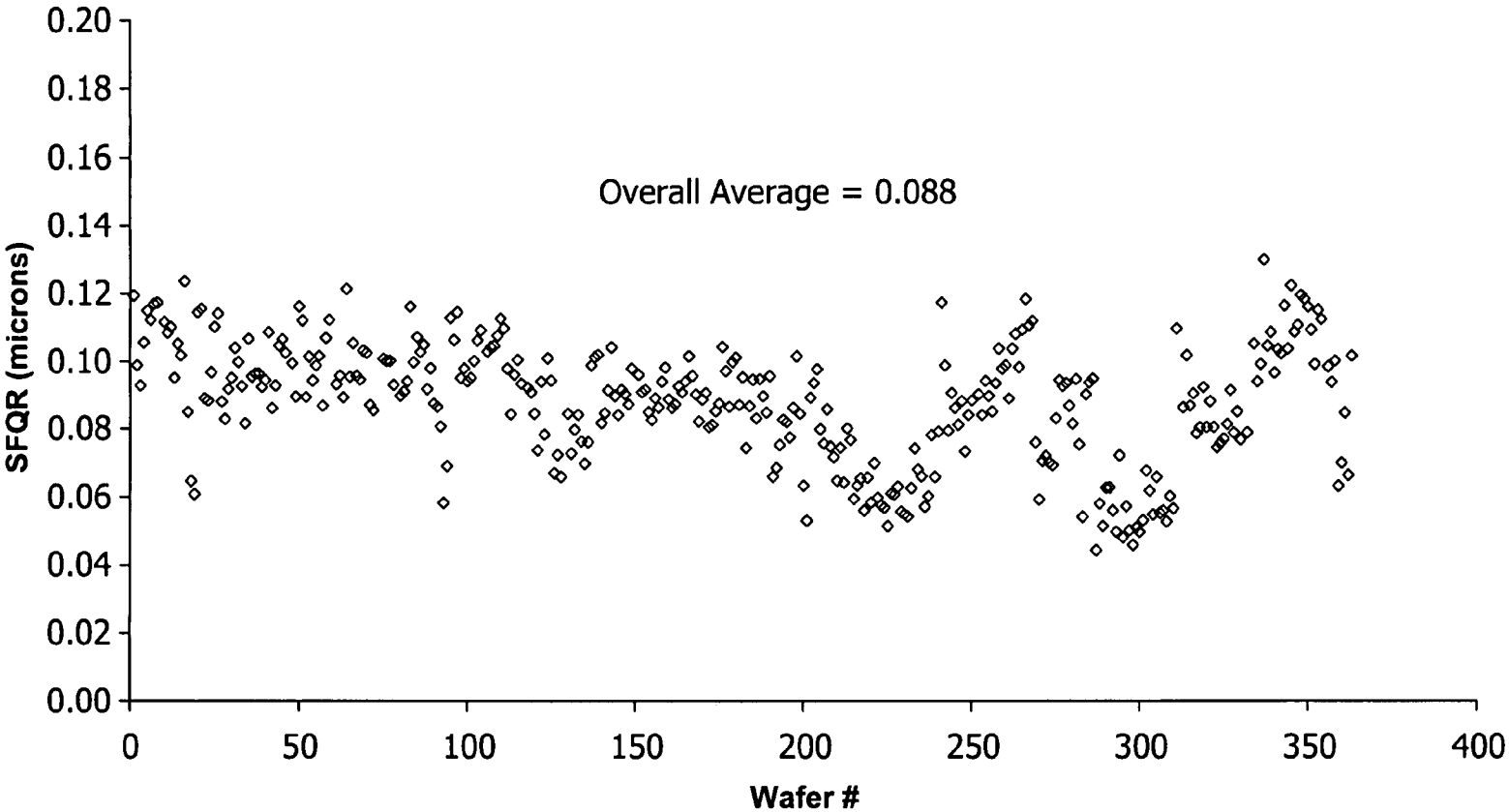
FIG. 8 is a graph depicting the average of the SFQR values for all partial sites on each wafer of the set polished on a conventional wafer polisher.
Figure 9:
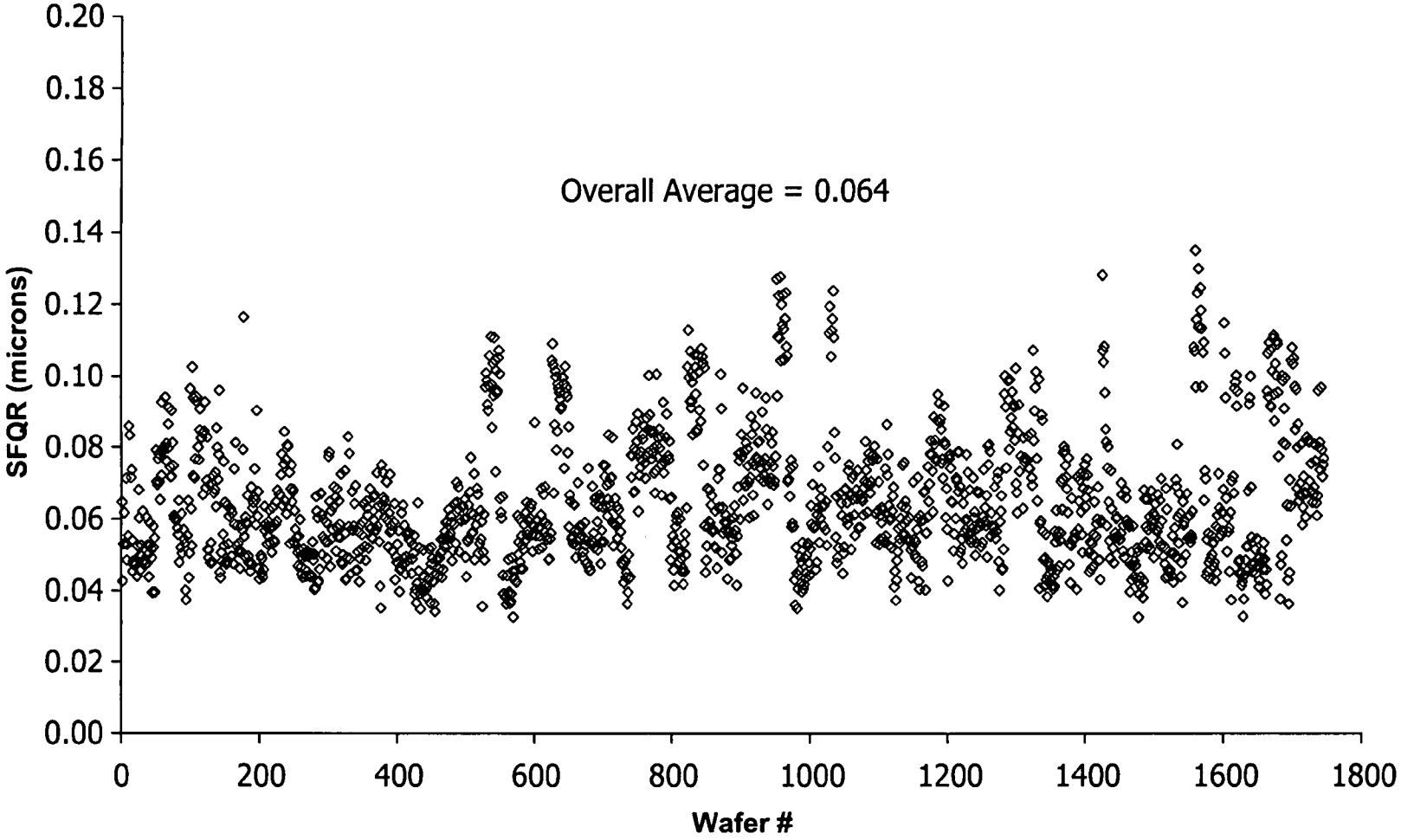
FIG. 9 is a graph depicting the average of the SFQR values for all partial sites on each wafer of the set polished on a wafer polisher of the present invention.

Another measurement of edge flatness is the average of the SFQR values for all partial sites 263 on a wafer. FIG. 8 depicts this measure for the same population of conventionally polished wafers shown in FIG. 6, and the average of the SFQR values for all partial sites 263 on a wafer on average is 0.088 microns (3.46 microinches). FIG. 9 depicts the identical measure for the same population of wafers polished according to the present invention shown in FIG. 7, wherein the average of the SFQR values for all partial sites 263 on a wafer on average is 0.064 microns (2.54 microinches). Wafers polished with an apparatus or method of the present invention yield a 26.7 percent (26.7%) increase in flatness over the conventional process. The wafers 35 exhibit improved flatness, allowing for accurate lithography of substantially the entire front surface 39 of the wafer.

Figure 10:
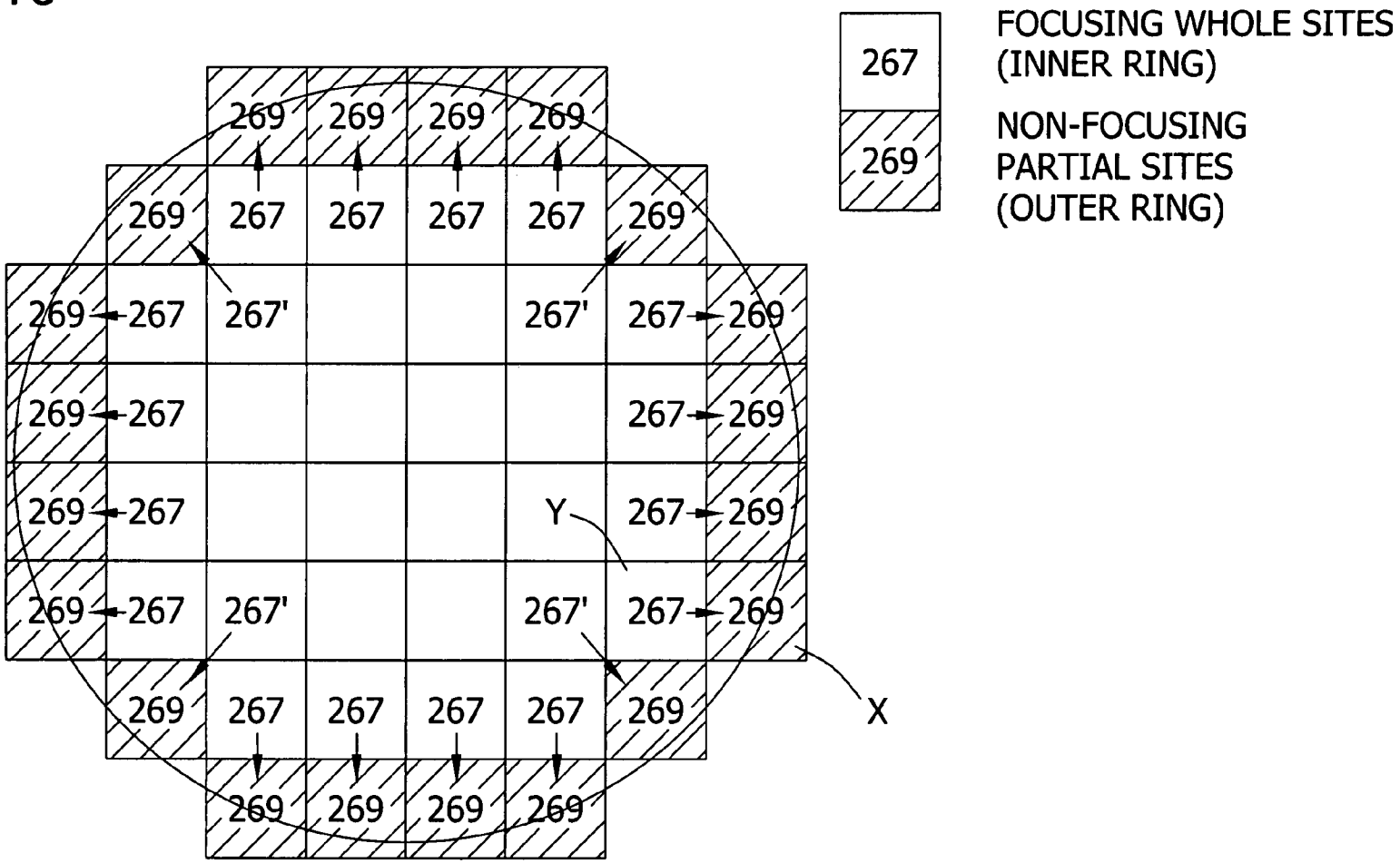
FIG. 10 is a schematic of a 200 millimeter (7.9 inches) diameter wafer indicating movement of a lithography apparatus from focusing whole sites to non-focusing partial sites.

An additional flatness parameter of importance is the flatness characteristics of adjacent sites. Lithography requires careful focusing of a lithography machine on the surface of a wafer. Focusing on whole sites 261 is routine, but focusing on partial sites 263 requires more advanced techniques, which add cost and time to the lithography process. Therefore, wafer lithographers often focus their lithographers on a focusing whole site 267,267' and then move to an immediately adjacent non-focusing partial site 269, assuming that the two sites are polished to a similar flatness so that the lithography of the partial site will also be in focus. These focusing whole sites 267,267' and non-focusing partial sites 269, although identical to the previous whole sites 261 and partial sites 263, are renumbered here to further describe the movements of a lithographer. FIG. 10 depicts (by arrows) the lithography machine movements from focusing sites 267,267' to non-focusing sites 269. For instance, a lithographer would likely not be able to accurately focus on site X because it is a partial site 269. Therefore, the lithographer would typically focus on site Y, and then move the camera in the direction indicated by the arrow to perform lithography on site X. The assumption regarding similar flatness characteristics of adjacent sites is only valid where the non-focusing sites 267 are polished similarly to the focusing sites 269. Where a wafer exhibits large edge roll-off, however, this assumption may lead to lithography errors. A wafer with comparable flatness characteristics in the center and at the edges 129 renders this assumption more acceptable.

Figure 11:
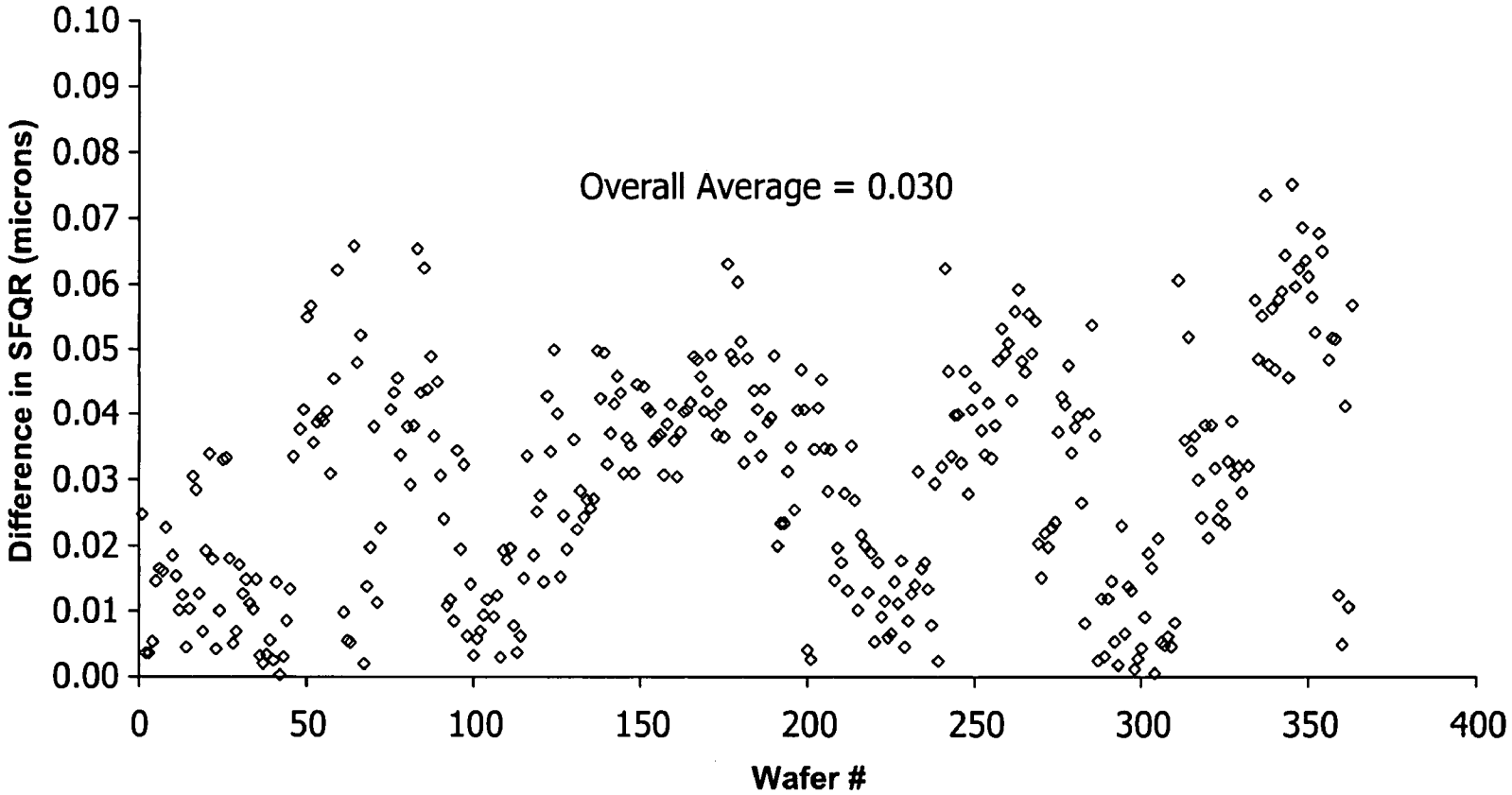
FIG. 11 is a graph depicting the difference between an average of the SFQR values for each site of an outer ring of partial sites and an average of the SFQR values for each site of an immediately adjacent inner ring of whole sites for each wafer polished on a conventional wafer polisher.
Figure 12:
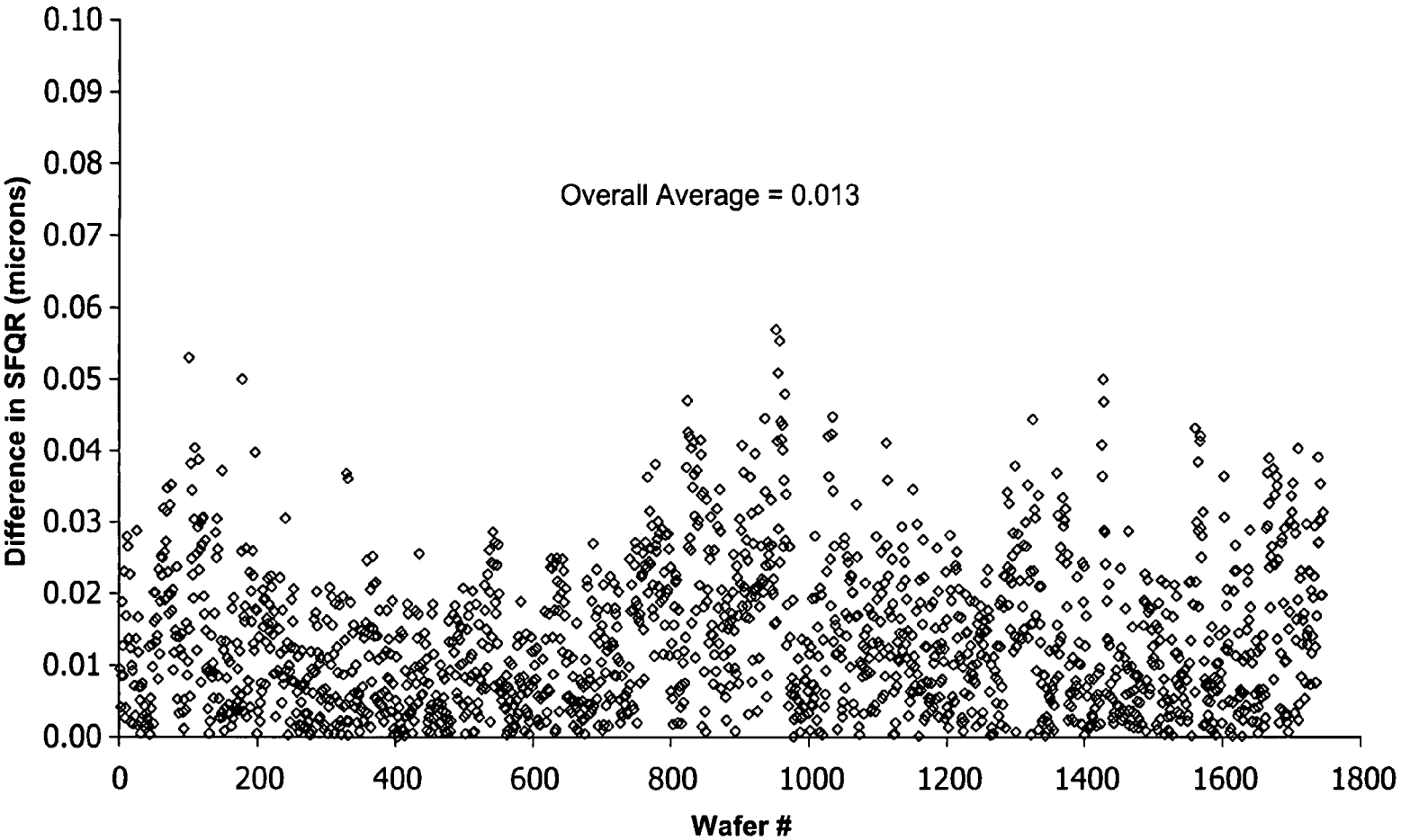
FIG. 12 is a graph depicting the difference between an average of the SFQR values for each site of an outer ring of partial sites and an average of the SFQR values for each site of an immediately adjacent inner ring of whole sites for each wafer polished on a wafer polisher of the present invention.

To quantify whether a wafer exhibits similar polishing at the partial sites and at an adjacent inner ring of whole sites, flatness data for the outer ring of non-focusing partial sites 269 and an inner ring of focusing whole sites 267 as defined in FIG. 5 (sites 267' are not included in the data for the focusing whole sites 267) can be compared. The data shown in FIG. 11 depict the difference between the average of the SFQR values for each site of an outer ring of twenty non-focusing partial sites 269 and an average of the SFQR values for each site of an immediately adjacent inner ring of sixteen focusing whole sites 267, for the same population of conventionally polished wafers shown in FIG. 6. The average SFQR difference for wafers polished on a conventional polisher is 0.030 microns (1.2 microinches). The data shown in FIG. 12 depict the difference between the average of the SFQR values for each site of an outer ring of twenty partial sites 269 and an average of the SFQR values for each site of an immediately adjacent inner ring of sixteen whole sites 267, for the same population of wafers of the present invention shown in FIG. 7. The average SFQR difference for wafers of the present invention is 0.013 microns (0.52 microinches). Wafers polished with an apparatus or method of the present invention yield a fifty-five percent (55%) increase in adjacent-site flatness over the conventional process. Wafers of the present invention allow for accurate lithography of partial sites 269 without refocusing the lithography apparatus on each partial site.

Figure 13:
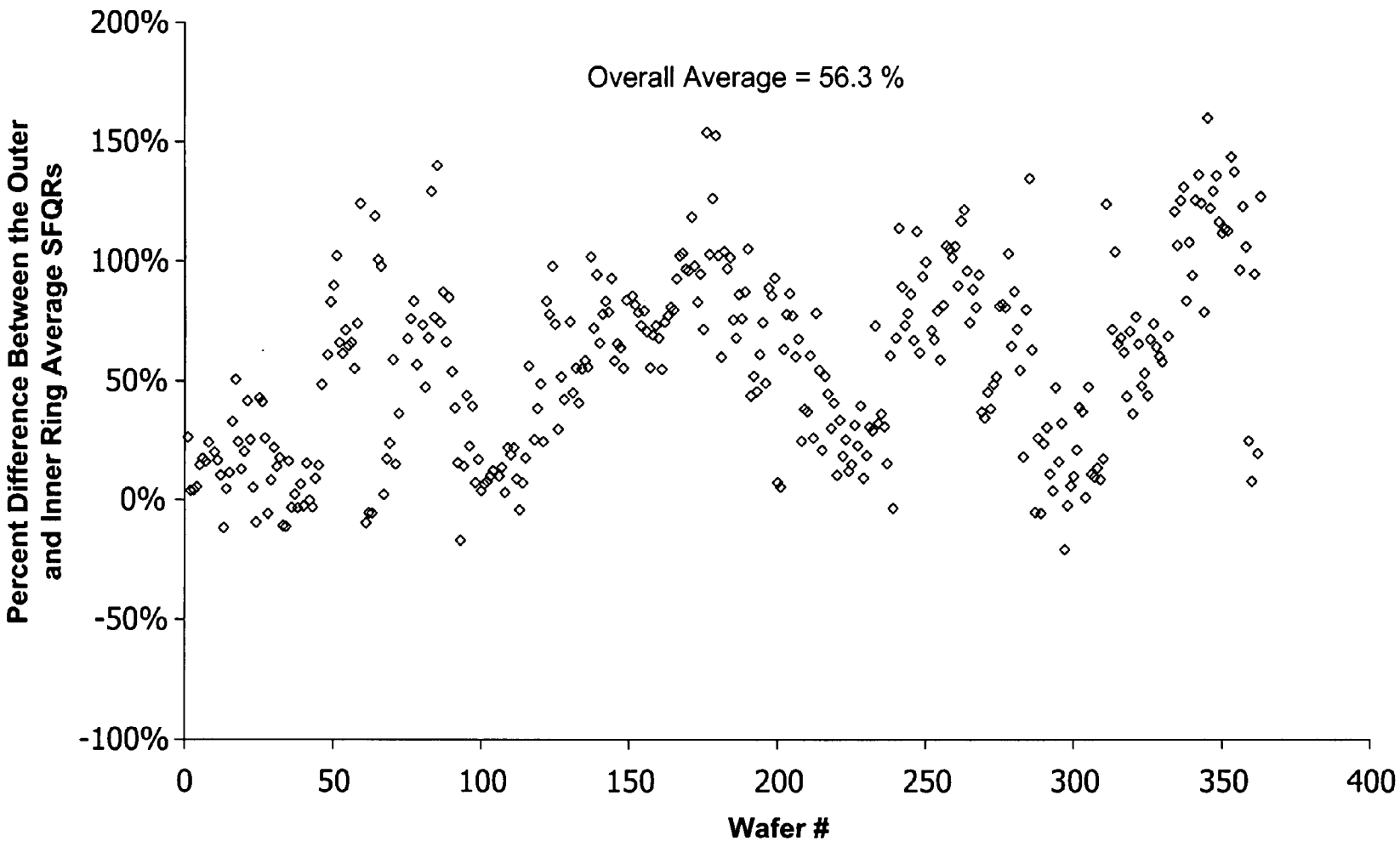
FIG. 13 is a graph depicting the percentile difference between an average of the SFQR values for each site of an outer ring of partial sites and an average of the SFQR values for each site of an immediately adjacent inner ring of whole sites for each wafer polished on a conventional wafer polisher.
Figure 14:
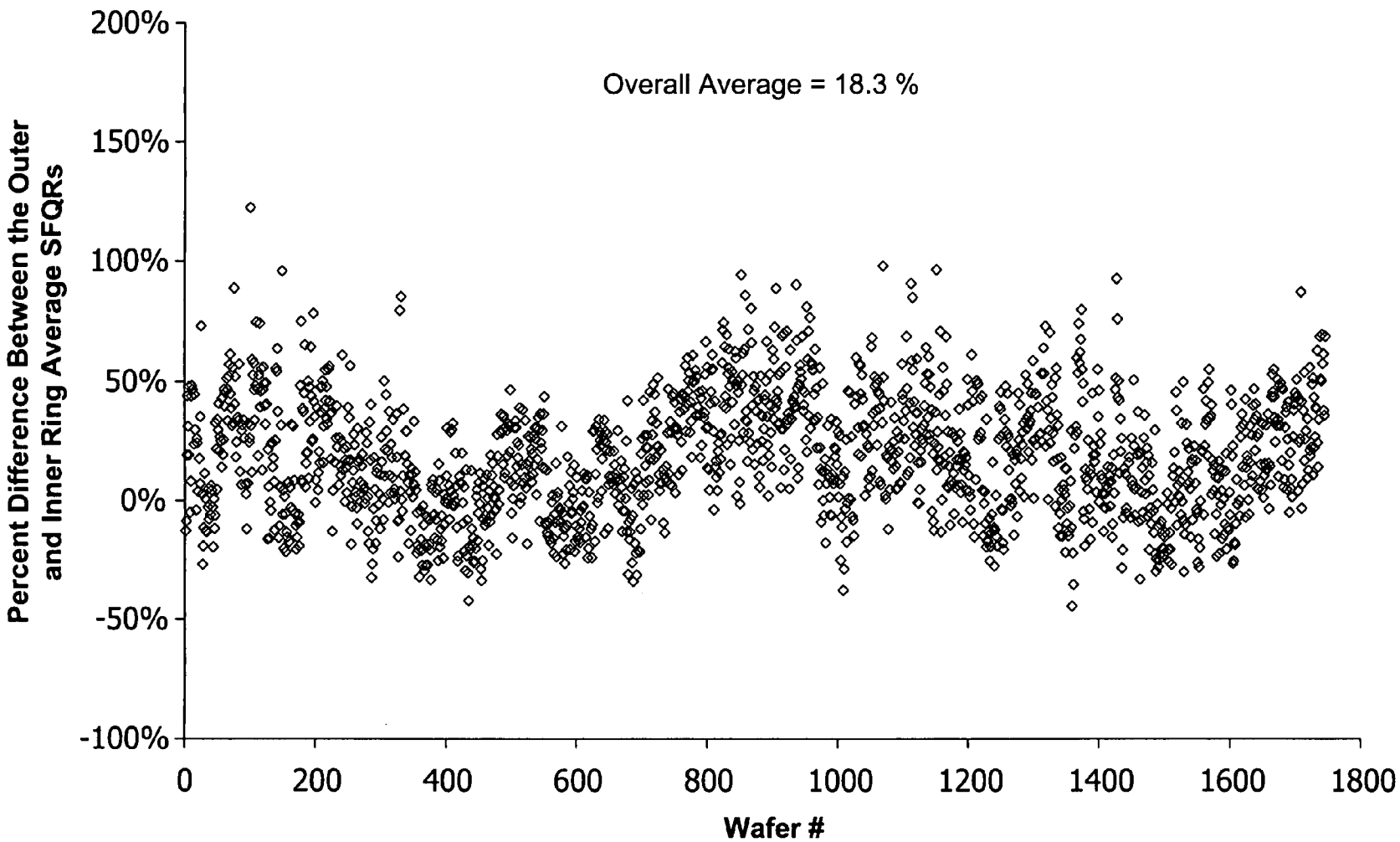
FIG. 14 is a graph depicting the percentile difference between an average of the SFQR values for each site of an outer ring of partial sites and an average of the SFQR values for each site of an immediately adjacent inner ring of whole sites for each wafer polished on a wafer polisher of the present invention.

Reviewing the data in another way, FIG. 13 depicts the percentile difference between the average of the SFQR values for each site of the outer ring of partial sites 269 and the average of the SFQR values for each site of the immediately adjacent inner ring of whole sites 267 for a conventional wafer polisher. The average percentile difference between the outer and inner ring average SFQR for wafers 35 polished on a conventional polisher is 56.3 percent (56.3%), for the same population of conventionally polished wafers shown in FIG. 6. In contrast, FIG. 14 depicts the same percentile difference for the same population of wafers 35 of the present invention used to construct FIG. 7. The average percentile difference between the outer and inner ring average SFQR for wafers polished on a wafer polisher of the present invention is 18.3 percent (18.3%). Thus, the polisher of the present invention yields a 67.6 percent (67.6%) decrease in this parameter over a conventional polisher. Therefore, wafers 35 polished according to the present invention will yield results having an average SFQR for an outer ring of partial sites 269 of less than fifty-five percent (55%) larger than an average of the SFQR values for an the inner ring of whole sites. Moreover, the present invention will yield an average SFQR difference between an inner ring and outer ring of less than thirty percent (30%) and likely less than eighteen percent (18%).

Figure 15:
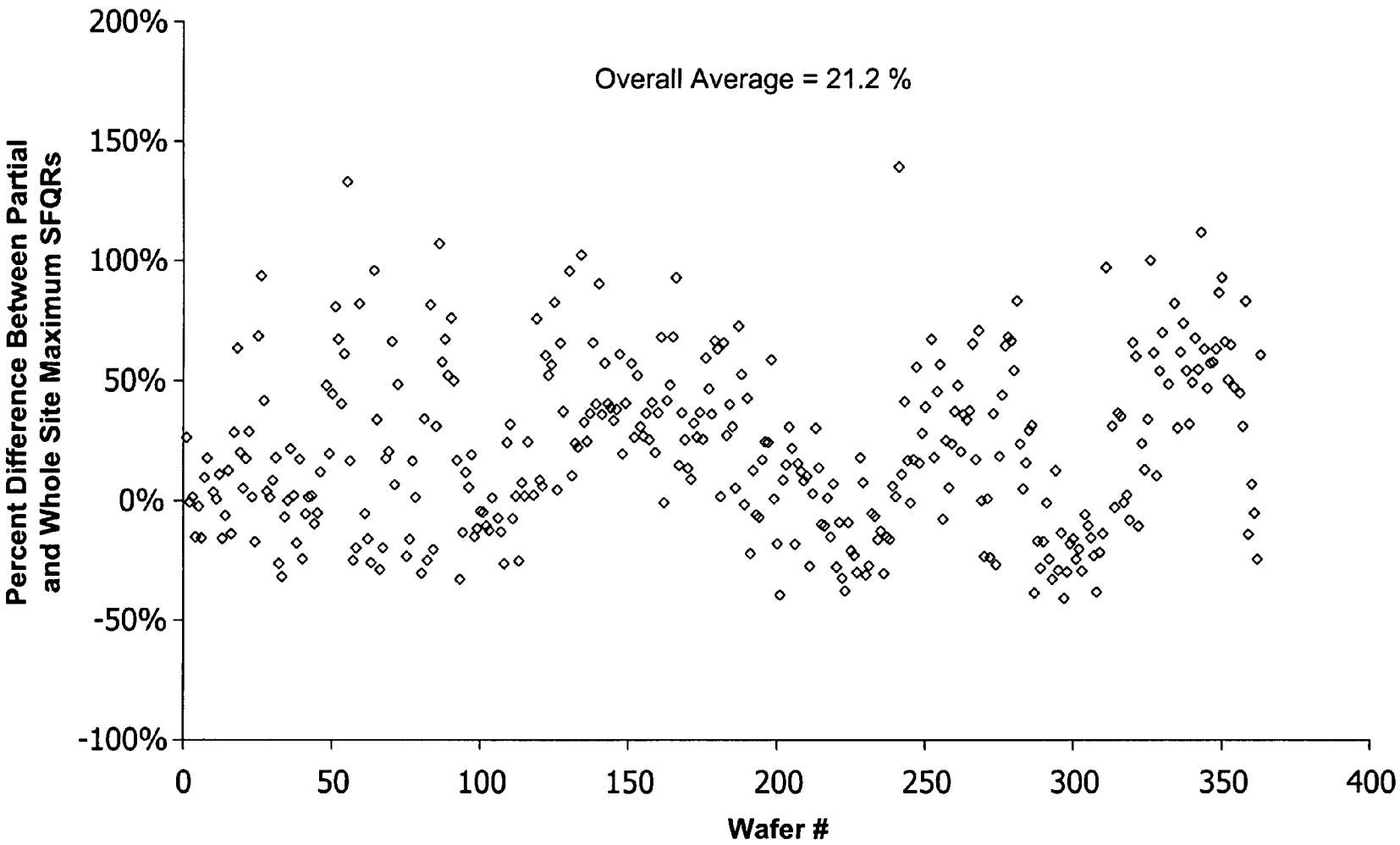
FIG. 15 is a graph depicting the percentile difference between the maximum SFQR value for any partial site of each wafer and the maximum SFQR value for any whole site of each wafer polished on a conventional wafer polisher.
Figure 16:
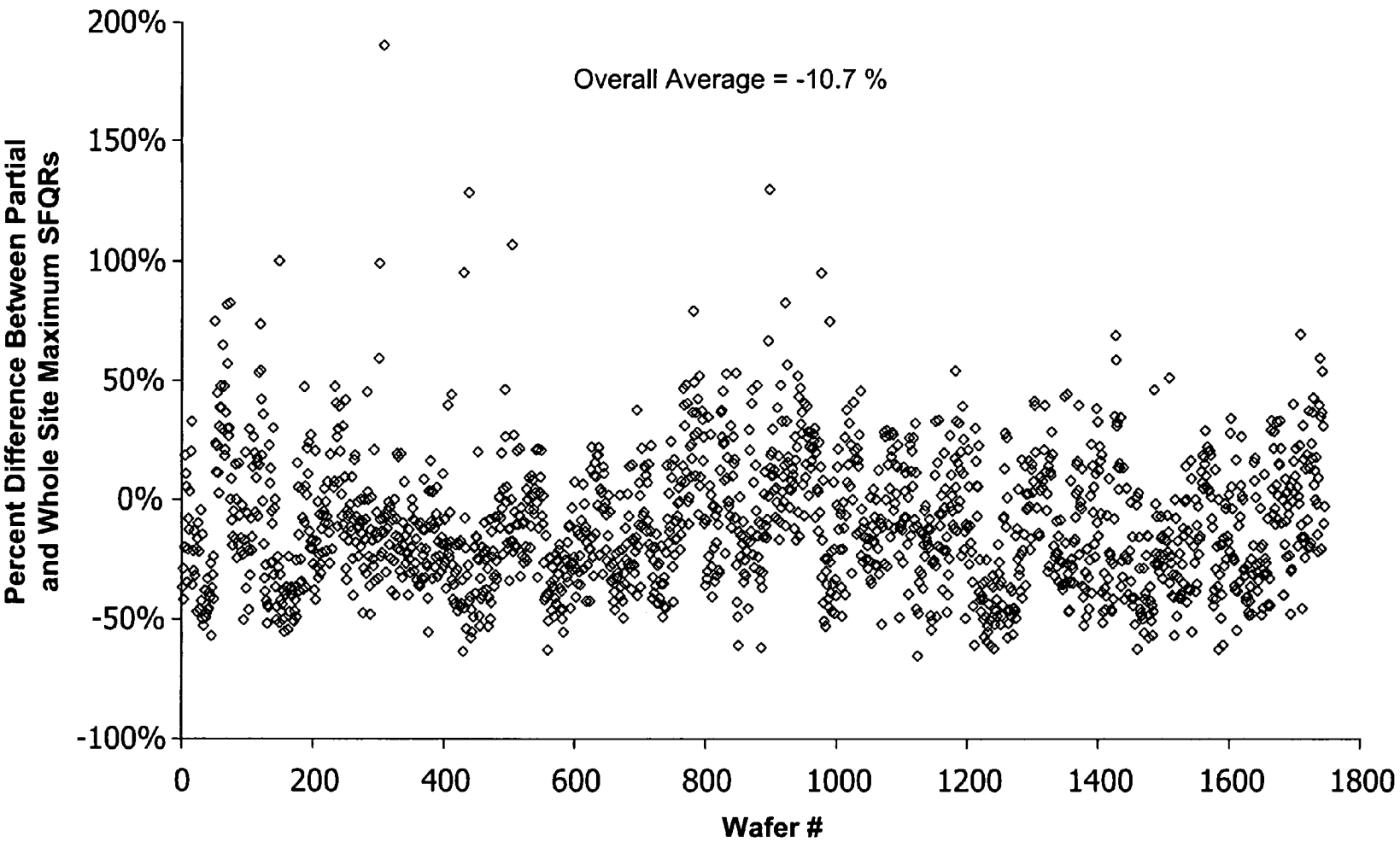
FIG. 16 is a graph depicting the percentile difference between the maximum SFQR value for any partial site of each wafer and the maximum SFQR value for any whole site of each wafer polished on a wafer polisher of the present invention.

One final measure of wafer 35 flatness is the percentile difference between a maximum SFQR value for any partial site 263 of each wafer and a maximum SFQR value for any whole site 261 of each wafer (FIG. 5). Referring now to FIG. 15, data showing such a comparison yields an average percentile difference between a partial site 263 maximum SFQR and a whole site 261 maximum SFQR of 21.2 percent (21.2%), for the same population of conventionally polished wafers 35 shown in FIG. 6. In contrast, FIG. 16 depicts the same percentile difference for the same population of wafers 35 of the present invention used to construct FIG. 7. The average percentile difference between the partial site 263 maximum SFQR and the whole site 261 maximum SFQR for wafers 35 polished on a wafer polisher of the present invention is −10.7 percent (−10.7%). The negative percentile value indicates that for wafers 35 polished according to the present invention, the partial site 263 maximum SFQR is likely less than the whole site 261 maximum SFQR. Contrary to conventionally polished wafers 35, these wafers tend to have lower SFQR maximums in their partial sites 263, rather than in their whole sites 261. Thus, the polisher of the present invention yields a significant improvement in this parameter over a conventional polisher. Therefore, wafers polished according to the present invention will yield maximum SFQR values for partial sites 263 which are no more than twenty percent (20%) larger than the maximum SFQR values for the whole sites 261. Moreover, the present invention will yield average maximum SFQR values for partial sites 263 of about the same and likely ten percent (10%) less than the maximum SFQR values for the whole sites 261.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. Wafer polishing apparatus comprising:

a base for supporting elements of the polishing apparatus;

a turntable having a polishing pad thereon and mounted on the base for rotation of the turntable and polishing pad relative to the base about an axis perpendicular to the turntable and polishing pad, the polishing pad including a work surface engageable with a front surface of a wafer for polishing the front surface of the wafer;

a drive mechanism mounted on the base for imparting rotational motion about an axis substantially parallel to the axis of the turntable;

a polishing head connected to the drive mechanism for driven rotation of the polishing head, the polishing head being adapted to hold at least one wafer for engaging a front surface of the wafer with the work surface of the polishing pad; and a spherical bearing assembly mounting the polishing head on the drive mechanism for pivoting of the polishing head about a gimbal point lying below the interface of the front surface of the wafer and the work surface on a side of the interface containing the turntable when the polishing head holds the wafer in engagement with the polishing pad, thereby allowing the plane of the front surface of the wafer to continuously align itself to apply slightly more polishing pressure to a trailing edge of the wafer, while rotation of the polishing head is driven by the driving mechanism for maintaining the front surface and work surface in flatwise engagement for more uniform polishing of a semiconductor wafer.

2. Wafer polishing apparatus as set forth in claim 1 further comprising a semi-rigid connection between the drive mechanism and the polishing head for imparting a rotational force from the drive mechanism to the polishing head so that the polishing head and drive mechanism rotate conjointly, while permitting universal pivoting motion of the polishing head with respect to the drive mechanism about the spherical bearing assembly.

3. Wafer polishing apparatus as set forth in claim 2 wherein the drive mechanism is adapted to drive the wafer carrier at a rotational speed of between about forty percent (40%) and about seventy percent (70%) of the rotational speed of the turntable.

4. Wafer polishing apparatus as set forth in claim 3 wherein the drive mechanism is adapted to drive the wafer carrier at a rotational speed of about fifty-five percent (55%) of the rotational speed of the turntable.

5. Wafer polishing apparatus as set forth in claim 2 wherein the semi-rigid connection comprises a flexible connection between the drive mechanism and the polishing head.

6. Wafer polishing apparatus as set forth in claim 5 wherein the flexible connection further comprises a torque transmittal boot attached to the drive mechanism and the polishing head, thereby allowing the polishing head to pivot with respect to the drive mechanism about the spherical bearing assembly for transmitting rotation from the drive mechanism to the polishing head.

7. Wafer polishing apparatus as set forth in claim 6 wherein the torque transmittal boot is made of an elastomeric material having a stiffness for transmitting the rotational energy of the drive mechanism to the polishing head and a resiliency to allow pivoting movement of the polishing head.

8. Wafer polishing apparatus as set forth in claim 7 wherein the elastomeric material is rubber.

9. Wafer polishing apparatus as set forth in claim 8 wherein said spherical bearing assembly further comprises an upper bearing member, a lower bearing member and a plurality of ball bearings, said ball bearings being engageable with the upper bearing member and the lower bearing member for relative movement between the members so that the polishing head may pivot relative to the drive mechanism.

10. Wafer polishing apparatus comprising a base for supporting elements of the polishing apparatus;

a turntable having a polishing pad thereon and mounted on the base for rotation of the turntable and polishing pad relative to the base about an axis perpendicular to the turntable and polishing pad, the polishing pad including a work surface engageable with a front surface of a wafer for polishing the front surface of the wafer;

a drive mechanism mounted on the base for imparting rotational motion about an axis substantially parallel to the axis of the turntable;

a polishing head connected to the drive mechanism for driven rotation of the polishing head, the polishing head being adapted to hold at least one wafer for engaging a front surface of the wafer with the work surface of the polishing pad;

a spherical bearing assembly mounting the polishing head on the drive mechanism for pivoting of the polishing head about a gimbal point lying below the interface of the front surface of the wafer and the work surface on a side of the interface containing the turntable when the polishing head holds the wafer in engagement with the polishing pad, thereby allowing the plane of the front surface of the wafer to continuously align itself to apply slightly more polishing pressure to a trailing edge of the wafer, while rotation of the polishing head is driven by the driving mechanism for maintaining the front surface and work surface in flatwise engagement for more uniform polishing of a semiconductor wafer, said spherical bearing assembly comprising an upper bearing member, a lower bearing member, and a plurality of ball bearings, said ball bearings being engageable with the upper bearing member and the lower bearing member for relative movement between the members so that the polishing head may pivot relative to the drive mechanism, wherein the upper bearing member and the lower bearing member have spherically shaped bearing surfaces, wherein the center of each spherical bearing surface corresponds to the gimbal point and any line normal to either surface passes through the gimbal point.

11. Wafer polishing apparatus as set forth in claim 10 wherein the drive mechanism further comprises a motor and a gearbox mounted on the base and attached to the drive mechanism for rotation of the drive mechanism.

12. Wafer polishing apparatus as set forth in claim 11 wherein an axis of rotation of the polishing head is spaced apart from an axis of rotation of the turntable.

13. Wafer polishing apparatus comprising:

a base for supporting elements of the polishing apparatus;

a turntable having a polishing pad thereon and mounted on the base for rotation of the turntable and polishing pad relative to the base about an axis perpendicular to the turntable and polishing pad, the polishing pad including a work surface engageable with a front surface of a wafer for polishing the front surface of the wafer;

a drive mechanism mounted on the base for imparting rotational motion about an axis substantially parallel to the axis of the turntable;

a polishing head connected to the drive mechanism for driven rotation of the polishing head, the polishing head being adapted to hold at least one wafer for engaging a front surface of the wafer with the work surface of the polishing pad a spherical bearing assembly mounting the polishing head on the drive mechanism for pivoting of the polishing head about a gimbal point lying below the interface of the front surface of the wafer and the work surface on a side of the interface containing the turntable when the polishing head holds the wafer in engagement with the polishing pad, thereby allowing the plane of the front surface of the wafer to continuously align itself to apply slightly more polishing pressure to a trailing edge of the wafer, while rotation of the polishing head is driven by the driving mechanism for maintaining the front surface and work surface in flatwise engagement for more uniform polishing of a semiconductor wafer; and a semi-rigid connection between the drive mechanism and the polishing head for imparting a rotational force from the drive mechanism to the polishing head so that the polishing head and drive mechanism rotate conjointly, while permitting universal pivoting motion of the polishing head with respect to the drive mechanism about the spherical bearing assembly, wherein the semi-rigid connection comprises at least one shoulder bolt attached to the polishing head and passing through at least one radial slot in the drive mechanism, the radial slot being sized slightly larger than the bolt so that as the drive mechanism rotates, the radial slot is engageable with the shoulder bolt for inducing rotation of the polishing head, while allowing the spherical bearing assembly to pivot slightly for more uniform polishing and continuous transmission of rotation from the drive mechanism to the polishing head.

14. Wafer polishing apparatus as set forth in claim 13 further comprising a membrane mounted on the polishing head, said membrane having an outer surface engageable with a wafer for mounting the wafer to the polishing head and an inner surface opposite the outer surface facing the polishing head.

15. Wafer polishing apparatus as set forth in claim 14 further comprising a vacuum source in fluid communication with a cavity formed between the inner surface of the membrane and the polishing head, said membrane having at least one hole formed therein so that when a vacuum is drawn in the cavity, the membrane can draw the wafer up against the membrane and hold the wafer, said membrane further holds the wafer when the wafer engages the work surface, whereby air may then be directed into the cavity, eliminating the vacuum and providing uniform air pressure within the cavity for pressing the wafer surface uniformly against the work surface.

16. Wafer polishing apparatus as set forth in claim 15 further comprising a retainer attached to the polishing head, said retainer extending from the polishing head below the wafer and membrane for retaining the wafer during polishing.

17. Wafer polishing apparatus as set forth in claim 16 wherein the membrane is movable independently of the retainer so that as the retainer wears, an offset between a bottom of the retainer and the membrane may be maintained.

18. Wafer polishing apparatus as set forth in claim 17 wherein the retainer is ring-shaped for encircling the membrane and wafer to retain the wafer during polishing.

19. Wafer polishing apparatus as set forth in claim 18 wherein the spherical bearing assembly further comprises an upper conical seat attached to and rotated with the drive mechanism and a lower spherical pivot rigidly mountable on the polishing head, said lower spherical pivot is engageable with the upper conical seat for pivotable movement of the polishing head with respect to the drive mechanism.

20. Wafer polishing apparatus as set forth in claim 19 wherein the lower spherical pivot has an upwardly directed spherical face, wherein any line normal to the spherical face passes through the gimbal point.

21. Wafer polishing apparatus as set forth in claim 13 further comprising a rigid backing plate and a retainer, both attached to the polishing head, said backing plate being adapted to apply uniform pressure over the entire wafer surface for even polishing of the wafer and said retainer extending from the polishing head below the backing surface for retaining the wafer during polishing.

22. Wafer polishing apparatus as set forth in claim 21 wherein the backing plate is movable independently of the retainer so that as the retainer wears, an offset between a bottom of the retainer and the backing plate may be maintained.

23. Wafer polishing apparatus as set forth in claim 22 wherein the retainer is ring-shaped for encircling the backing plate and wafer to retain the wafer during polishing.

24. Wafer polishing apparatus as set forth in claim 23 wherein the polishing head is adapted to hold a single wafer for engaging the front surface of the wafer with the work surface of the polishing pad.

25. A method of polishing a semiconductor wafer comprising the steps of:

placing the semiconductor wafer in a polishing head of a wafer polishing apparatus;

driving rotation of a polishing pad on a turntable of the polishing apparatus about a first axis;

driving rotation of the polishing head generally about a second axis non-coincident with the first axis;

positioning the wafer held by the polishing head so that a front surface of the wafer engages a work surface of the polishing pad;

urging the front surface of the wafer against the polishing pad;

holding the polishing head for free pivoting movement about a gimbal point located below an interface of the work surface and the front surface of the wafer on a side of the interface containing the turntable as rotation of the polishing head continues to be driven to apply slightly more polishing pressure to a trailing edge of the wafer in response to a net force about the gimbal point acting in a direction perpendicular to the front surface of the wafer, while preventing pivoting of the front surface of the wafer under forces parallel to the front surface of the wafer passing generally through the gimbal point;

disengaging the wafer from the turntable; and removing the wafer from the polishing head.

26. A method as set forth in claim 25 wherein the step for placing the semiconductor wafer comprises adhering the wafer to a polishing block and securing the polishing block to the polishing head.

27. A method as set forth in claim 25 wherein the driving step comprises rotating the polishing head at a speed less than the rotational speed of the turntable.

28. A method as set forth in claim 27 wherein the driving step comprises rotating the drive mechanism at a speed of between about forty percent (40%) and about seventy percent (70%) of the rotational speed of the turntable.

29. A method as set forth in claim 28 wherein the driving step comprises rotating the drive mechanism at a speed of about fifty-five percent (55%) of the rotational speed of the turntable.

30. A method as set forth in claim 25 wherein the placing step further comprises mounting the wafer on a membrane mounted on the polishing head by evacuating a cavity behind the membrane to draw the wafer up against the membrane and hold the wafer during the polishing step, the method further comprising selectively varying air pressure within the cavity for pressing the wafer surface uniformly against the work surface.

* * * * *